US011205835B2

(12) United States Patent
Kim

(10) Patent No.: US 11,205,835 B2
(45) Date of Patent: Dec. 21, 2021

(54) ELECTRONIC DEVICE INCLUDING ANTENNA MODULE

(71) Applicant: Samsung Electronics Co., Ltd., Gyeonggi-do (KR)

(72) Inventor: Yeonwoo Kim, Gyeonggi-do (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 16/932,945

(22) Filed: Jul. 20, 2020

(65) Prior Publication Data

US 2021/0066788 A1 Mar. 4, 2021

(30) Foreign Application Priority Data

Aug. 30, 2019 (KR) ..... 10-2019-0106955

(51) Int. Cl.
*H01Q 3/34* (2006.01)
*H01Q 1/24* (2006.01)

(52) U.S. Cl.
CPC ..... *H01Q 1/243* (2013.01); *H01Q 3/34* (2013.01)

(58) Field of Classification Search
CPC ..... H01G 1/243; H01G 3/34
See application file for complete search history.

(56) References Cited

U.S. PATENT DOCUMENTS 5,898,405 A 4/1999 Iwasaki
2014/0306846 A1 10/2014 Nakatsu et al.
2019/0020100 A1 1/2019 Jong et al.
2019/0020110 A1 1/2019 Paulotto et al.
2019/0103682 A1 4/2019 Thai et al.
2019/0165472 A1 5/2019 Yun et al.
2020/0412022 A1 12/2020 Yun et al.

FOREIGN PATENT DOCUMENTS

KR 10-2019-0062064 A 6/2019
KR 10-2019-0098529 A 8/2019
KR 10-2020-0014601 A 2/2020
KR 10-2020-0024408 A 3/2020

OTHER PUBLICATIONS

International Search Report dated Nov. 13, 2020.

*Primary Examiner* — Graham P Smith
(74) *Attorney, Agent, or Firm* — Cha & Reiter, LLC

(57) ABSTRACT

Disclosed in one embodiment is an antenna module which includes a printed circuit board (PCB) that includes a first surface, a second surface, and a third surface, a first antenna that is disposed on the first surface, a second antenna that includes a first portion disposed on the second surface, a second portion extended from the first portion so as to be adjacent to the third surface, and a third portion extended from the second portion so as to face the first antenna, at least one ground layer that is interposed between the first antenna and the second antenna, and at least one wire that feeds the first antenna and the second antenna. The first antenna and at least a portion of the first portion overlap each other when viewed in the second direction, and the first antenna and the second portion are disposed to be spaced from each other.

20 Claims, 26 Drawing Sheets

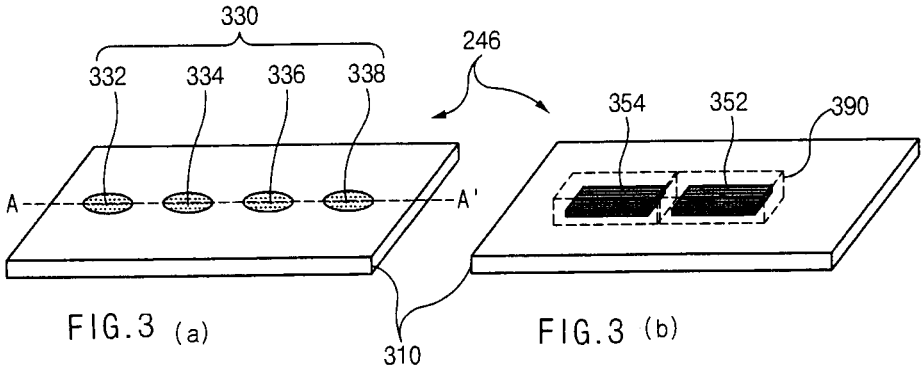
FIG.3 (a)
FIG.3 (b)
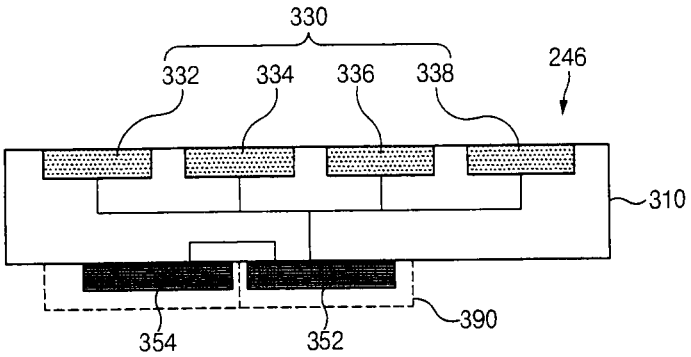
FIG.3 (c)

ELECTRONIC DEVICE INCLUDING ANTENNA MODULE

CROSS-REFERENCE TO RELATED APPLICATION(S)

This application is based on and claims priority under 35 U.S.C. § 119 to Korean Patent Application No. 10-2019-0106955, filed on Aug. 30, 2019, in the Korean Intellectual Property Office, the disclosure of which is incorporated by reference herein its entirety.

BACKGROUND

1. Field

One or more embodiments of the instant disclosure generally relate to an electronic device that includes an antenna module.

2. Description of Related Art

As mobile communication technologies have developed, electronic devices that are equipped with antennas have become widely available. These electronic devices may transmit and/or receive radio frequency (RF) signals such as voice signals or data (e.g., message, photo, video, music file, or game) by using the antenna. The electronic devices may perform communication by using high frequency (e.g., $5^{th}$ generation (5G) communication or millimeter wave (mm-Wave)) protocol. An antenna module that performs high-frequency communication may be implemented by a radiator and a radio frequency integrated circuit (RFIC) supplying or feeding signals on a printed circuit board (PCB).

When performing the high-frequency communication, an antenna array may be used to overcome high transmission loss. For example, in the case of performing the high-frequency communication, one or more patches may be disposed at the antenna array for the purpose of securing beamforming performance. In the case of performing the high-frequency communication, a beam may be formed to progress in one particular direction. Various kinds of antenna patterns may be used as the radiator for the purpose of forming beams in a plurality of directions.

The above information is presented as background information only to assist with an understanding of the disclosure. No determination has been made, and no assertion is made, as to whether any of the above might be applicable as prior art with regard to the disclosure.

SUMMARY

In the case of performing high-frequency communication, an array antenna may adjust a phase of a beam in order to perform beam steering while moving the beam. The beam for the high-frequency communication may have high straightness. Even though antenna patterns are disposed in one or more directions for the purpose of increasing the arrival angle and/or the arrival range of the beam, the arrival angle and/or the arrival range may still be too restrictive due to the straightness of the beam and/or the arrangement structure of an antenna.

In accordance with an aspect of the disclosure, an antenna module may include a printed circuit board (PCB) that includes a first surface facing a first direction, a second surface facing a second direction opposite to the first surface, and a third surface facing a third direction perpendicular to the first direction and the second direction, a first antenna that is disposed on the first surface, a second antenna that includes a first portion disposed on the second surface, a second portion extended from a first point of the first portion in the first direction so as to be adjacent to the third surface, and a third portion extended from a second point of the second portion so as to face the first antenna, at least one ground layer that is interposed between the first antenna and the second antenna and extending in the third direction, the at least one ground layer includes a bending portion bent to face the first direction from the third direction, and at least one wire that feeds the first antenna and the second antenna. The first antenna and at least a portion of the first portion excluding the first point may overlap each other when viewed in the second direction, the first antenna and the second portion may be disposed to be spaced from each other in the third direction, and at least a portion of the at least one ground layer may be interposed between the first antenna and the second portion.

In accordance with another aspect of the disclosure, an antenna module may include a PCB that includes a first surface facing a first direction, a second surface facing a second direction opposite to the first direction, and a third surface facing a third direction perpendicular to the first direction and the second direction, a first antenna that is disposed on the first surface, a second antenna that is disposed on the second surface, wherein at least a portion of the second antenna is disposed to overlap the first antenna when viewed in the second direction, at least one ground layer that is interposed between the first antenna and the second antenna, a first feeding terminal that feeds a first signal having a first phase to the first antenna, a second feeding terminal that feeds a second signal having a second phase to the first antenna, a third feeding terminal that is disposed to face the first feeding terminal and feeds a third signal having a third phase to the second antenna, and a fourth feeding terminal that is disposed to face the first feeding terminal and feeds a fourth signal having a fourth phase to the second antenna. A first current flow may be formed on the first antenna by the first signal and the second signal, a second current flow different from the first current flow may be formed on the second antenna by the third signal and the fourth signal, the first feeding terminal may be fed in synchronization with the third feeding terminal, and the second feeding terminal may be fed in synchronization with the fourth feeding terminal.

In accordance with another aspect of the disclosure, an electronic device may include a housing that includes a front plate, a back plate facing away from the front plate, and a side member formed in a space between the front plate and the back plate, wherein at least a part of the side member is made of a conductive material, and an antenna module that is disposed within the housing. The antenna module may include a PCB that includes a first surface, a second surface parallel to the first surface, and a third surface connecting the first surface and the second surface, a first antenna disposed on the first surface, a second antenna that is extended from the second surface while being bent to face the third surface and is extended from the third surface while being bent to face the first antenna on the first surface, at least one ground layer that is interposed between the first antenna and the second antenna and includes a bending portion bent in a shape corresponding to the second antenna, a radio frequency integrated circuit (RFIC) that is disposed adjacent to the second surface, and at least one wire that connects the first antenna and the second antenna with the RFIC. The second antenna may be disposed to be spaced apart from the RFIC.

Other aspects, advantages, and salient features of the disclosure will become apparent to those skilled in the art from the following detailed description, which, taken in conjunction with the annexed drawings, discloses various embodiments of the disclosure.

BRIEF DESCRIPTION OF THE DRAWINGS

The above and other aspects, features, and advantages of certain embodiments of the disclosure will be more apparent from the following description taken in conjunction with the accompanying drawings, in which:

FIGS. 3(*a*) to 3(*c*) are diagrams illustrating a third antenna module described with reference to FIG. 2;

With regard to description of drawings, similar components may be marked by similar reference numerals.

DETAILED DESCRIPTION

Aspects of the disclosure are to address at least the above-mentioned problems and/or disadvantages and to provide at least the advantages described below. Accordingly, an aspect of the disclosure is to provide an antenna module capable of steering beams in 360 degrees around an electronic device by using an antenna module. An electronic device including the same is also disclosed.

Hereinafter, certain embodiments of the disclosure will be described with reference to accompanying drawings. However, those of ordinary skill in the art will recognize that modification, equivalent, and/or alternative on these embodiments described herein can be made without departing from the scope and spirit of the disclosure.

Figure 1:
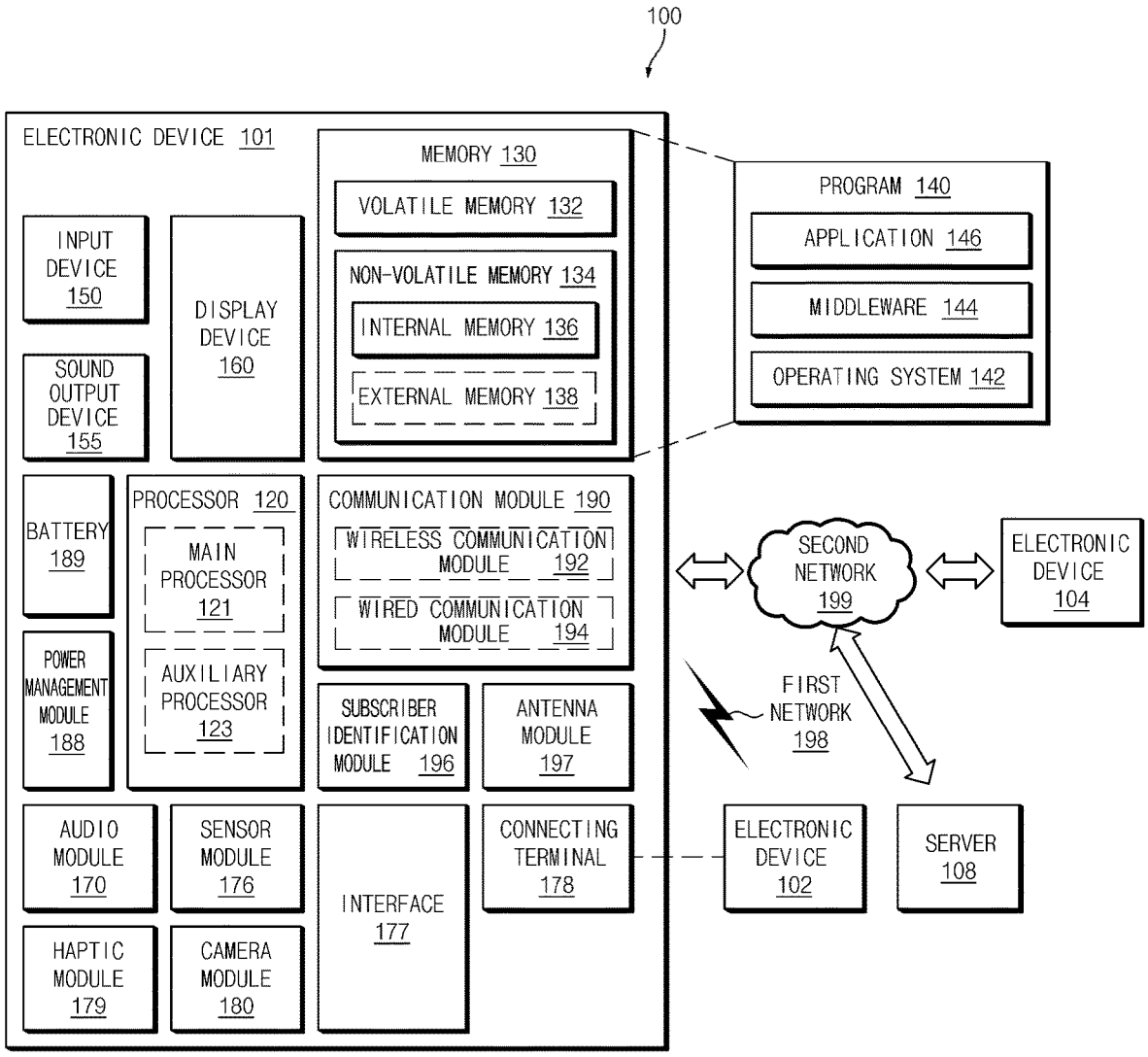
FIG. 1 is a block diagram illustrating an electronic device in a network environment according to various embodiments.

FIG. 1 is a block diagram illustrating an electronic device 101 in a network environment 100 according to various embodiments. Referring to FIG. 1, the electronic device 101 in the network environment 100 may communicate with an electronic device 102 via a first network 198 (e.g., a short-range wireless communication network), or an electronic device 104 or a server 108 via a second network 199 (e.g., a long-range wireless communication network). According to an embodiment, the electronic device 101 may communicate with the electronic device 104 via the server 108. According to an embodiment, the electronic device 101 may include a processor 120, memory 130, an input device 150, a sound output device 155, a display device 160, an audio module 170, a sensor module 176, an interface 177, a haptic module 179, a camera module 180, a power management module 188, a battery 189, a communication module 190, a subscriber identification module (SIM) 196, or an antenna module 197. In some embodiments, at least one (e.g., the display device 160 or the camera module 180) of the components may be omitted from the electronic device 101, or one or more other components may be added in the electronic device 101. In some embodiments, some of the components may be implemented as single integrated circuitry. For example, the sensor module 176 (e.g., a fingerprint sensor, an iris sensor, or an illuminance sensor) may be implemented as embedded in the display device 160 (e.g., a display).

The processor 120 may execute, for example, software (e.g., a program 140) to control at least one other component (e.g., a hardware or software component) of the electronic device 101 coupled with the processor 120, and may perform various data processing or computation. According to one embodiment, as at least part of the data processing or computation, the processor 120 may load a command or data received from another component (e.g., the sensor module 176 or the communication module 190) in volatile memory 132, process the command or the data stored in the volatile memory 132, and store resulting data in non-volatile memory 134. According to an embodiment, the processor 120 may include a main processor 121 (e.g., a central processing unit (CPU) or an application processor (AP)), and an auxiliary processor 123 (e.g., a graphics processing unit (GPU), an image signal processor (ISP), a sensor hub processor, or a communication processor (CP)) that is operable independently from, or in conjunction with, the main processor 121. Additionally or alternatively, the auxiliary processor 123 may be adapted to consume less power than the main processor 121, or to be specific to a specified function. The auxiliary processor 123 may be implemented as separate from, or as part of the main processor 121.

The auxiliary processor 123 may control at least some of functions or states related to at least one component (e.g., the display device 160, the sensor module 176, or the communication module 190) among the components of the electronic device 101, instead of the main processor 121 while the main processor 121 is in an inactive (e.g., sleep) state, or together with the main processor 121 while the main processor 121 is in an active state (e.g., executing an application). According to an embodiment, the auxiliary processor 123 (e.g., an image signal processor or a communication processor) may be implemented as part of another component (e.g., the camera module 180 or the communication module 190) functionally related to the auxiliary processor 123.

The memory 130 may store various data used by at least one component (e.g., the processor 120 or the sensor module 176) of the electronic device 101. The various data may include, for example, software (e.g., the program 140) and input data or output data for a command related thereto. The memory 130 may include the volatile memory 132 or the non-volatile memory 134.

The program 140 may be stored in the memory 130 as software, and may include, for example, an operating system (OS) 142, middleware 144, or an application 146.

The input device 150 may receive a command or data to be used by other component (e.g., the processor 120) of the electronic device 101, from the outside (e.g., a user) of the electronic device 101. The input device 150 may include, for example, a microphone, a mouse, a keyboard, or a digital pen (e.g., a stylus pen).

The sound output device 155 may output sound signals to the outside of the electronic device 101. The sound output device 155 may include, for example, a speaker or a receiver. The speaker may be used for general purposes, such as playing multimedia or playing record, and the receiver may be used for an incoming calls. According to an embodiment, the receiver may be implemented as separate from, or as part of the speaker.

The display device 160 may visually provide information to the outside (e.g., a user) of the electronic device 101. The display device 160 may include, for example, a display, a hologram device, or a projector and control circuitry to control a corresponding one of the display, hologram device, and projector. According to an embodiment, the display device 160 may include touch circuitry adapted to detect a touch, or sensor circuitry (e.g., a pressure sensor) adapted to measure the intensity of force incurred by the touch.

The audio module 170 may convert a sound into an electrical signal and vice versa. According to an embodiment, the audio module 170 may obtain the sound via the input device 150, or output the sound via the sound output device 155 or a headphone of an external electronic device (e.g., an electronic device 102) directly (e.g., wiredly) or wirelessly coupled with the electronic device 101.

The sensor module 176 may detect an operational state (e.g., power or temperature) of the electronic device 101 or an environmental state (e.g., a state of a user) external to the electronic device 101, and then generate an electrical signal or data value corresponding to the detected state. According to an embodiment, the sensor module 176 may include, for example, a gesture sensor, a gyro sensor, an atmospheric pressure sensor, a magnetic sensor, an acceleration sensor, a grip sensor, a proximity sensor, a color sensor, an infrared (IR) sensor, a biometric sensor, a temperature sensor, a humidity sensor, or an illuminance sensor.

The interface 177 may support one or more specified protocols to be used for the electronic device 101 to be coupled with the external electronic device (e.g., the electronic device 102) directly (e.g., wiredly) or wirelessly. According to an embodiment, the interface 177 may include, for example, a high definition multimedia interface (HDMI), a universal serial bus (USB) interface, a secure digital (SD) card interface, or an audio interface.

A connecting terminal 178 may include a connector via which the electronic device 101 may be physically connected with the external electronic device (e.g., the electronic device 102). According to an embodiment, the connecting terminal 178 may include, for example, a HDMI connector, a USB connector, a SD card connector, or an audio connector (e.g., a headphone connector).

The haptic module 179 may convert an electrical signal into a mechanical stimulus (e.g., a vibration or a movement) or electrical stimulus which may be recognized by a user via his tactile sensation or kinesthetic sensation. According to an embodiment, the haptic module 179 may include, for example, a motor, a piezoelectric element, or an electric stimulator.

The camera module 180 may capture a still image or moving images. According to an embodiment, the camera module 180 may include one or more lenses, image sensors, image signal processors, or flashes.

The power management module 188 may manage power supplied to the electronic device 101. According to one embodiment, the power management module 188 may be implemented as at least part of, for example, a power management integrated circuit (PMIC).

The battery 189 may supply power to at least one component of the electronic device 101. According to an embodiment, the battery 189 may include, for example, a primary cell which is not rechargeable, a secondary cell which is rechargeable, or a fuel cell.

The communication module 190 may support establishing a direct (e.g., wired) communication channel or a wireless communication channel between the electronic device 101 and the external electronic device (e.g., the electronic device 102, the electronic device 104, or the server 108) and performing communication via the established communication channel. The communication module 190 may include one or more communication processors that are operable independently from the processor 120 (e.g., the application processor (AP)) and supports a direct (e.g., wired) communication or a wireless communication. According to an embodiment, the communication module 190 may include a wireless communication module 192 (e.g., a cellular communication module, a short-range wireless communication module, or a global navigation satellite system (GNSS) communication module) or a wired communication module 194 (e.g., a local area network (LAN) communication module or a power line communication (PLC) module). A corresponding one of these communication modules may communicate with the external electronic device via the first network 198 (e.g., a short-range communication network, such as Bluetooth™, wireless-fidelity (Wi-Fi) direct, or infrared data association (IrDA)) or the second network 199 (e.g., a long-range communication network, such as a cellular network, the Internet, or a computer network (e.g., LAN or wide area network (WAN)). These various types of communication modules may be implemented as a single component (e.g., a single chip), or may be implemented as multi components (e.g., multi chips) separate from each other. The wireless communication module 192 may identify and authenticate the electronic device 101 in a communication network, such as the first network 198 or the second network 199, using subscriber information (e.g., international mobile subscriber identity (IMSI)) stored in the subscriber identification module 196.

The antenna module 197 may transmit or receive a signal or power to or from the outside (e.g., the external electronic device) of the electronic device 101. According to an embodiment, the antenna module 197 may include an antenna including a radiating element composed of a conductive material or a conductive pattern formed in or on a substrate (e.g., printed circuit board or "PCB"). According to an embodiment, the antenna module 197 may include a plurality of antennas. In such a case, at least one antenna appropriate for a communication scheme used in the communication network, such as the first network 198 or the second network 199, may be selected, for example, by the communication module 190 (e.g., the wireless communication module 192) from the plurality of antennas. The signal or the power may then be transmitted or received between the communication module 190 and the external electronic device via the selected at least one antenna. According to an embodiment, another component (e.g., a radio frequency integrated circuit (RFIC)) other than the radiating element may be additionally formed as part of the antenna module 197.

At least some of the above-described components may be coupled mutually and communicate signals (e.g., commands or data) therebetween via an inter-peripheral communication scheme (e.g., a bus, general purpose input and output (GPIO), serial peripheral interface (SPI), or mobile industry processor interface (MIPI)).

According to an embodiment, commands or data may be transmitted or received between the electronic device 101 and the external electronic device 104 via the server 108 coupled with the second network 199. Each of the electronic devices 102 and 104 may be a device of a same type as, or a different type, from the electronic device 101. According to an embodiment, all or some of operations to be executed at the electronic device 101 may be executed at one or more of the external electronic devices 102, 104, or 108. For example, if the electronic device 101 should perform a function or a service automatically, or in response to a request from a user or another device, the electronic device 101, instead of, or in addition to, executing the function or the service, may request the one or more external electronic devices to perform at least part of the function or the service. The one or more external electronic devices receiving the request may perform the at least part of the function or the service requested, or an additional function or an additional service related to the request, and transfer an outcome of the performing to the electronic device 101. The electronic device 101 may provide the outcome, with or without further processing of the outcome, as at least part of a reply to the request. To that end, a cloud computing, distributed computing, or client-server computing technology may be used, for example.

Figure 2:
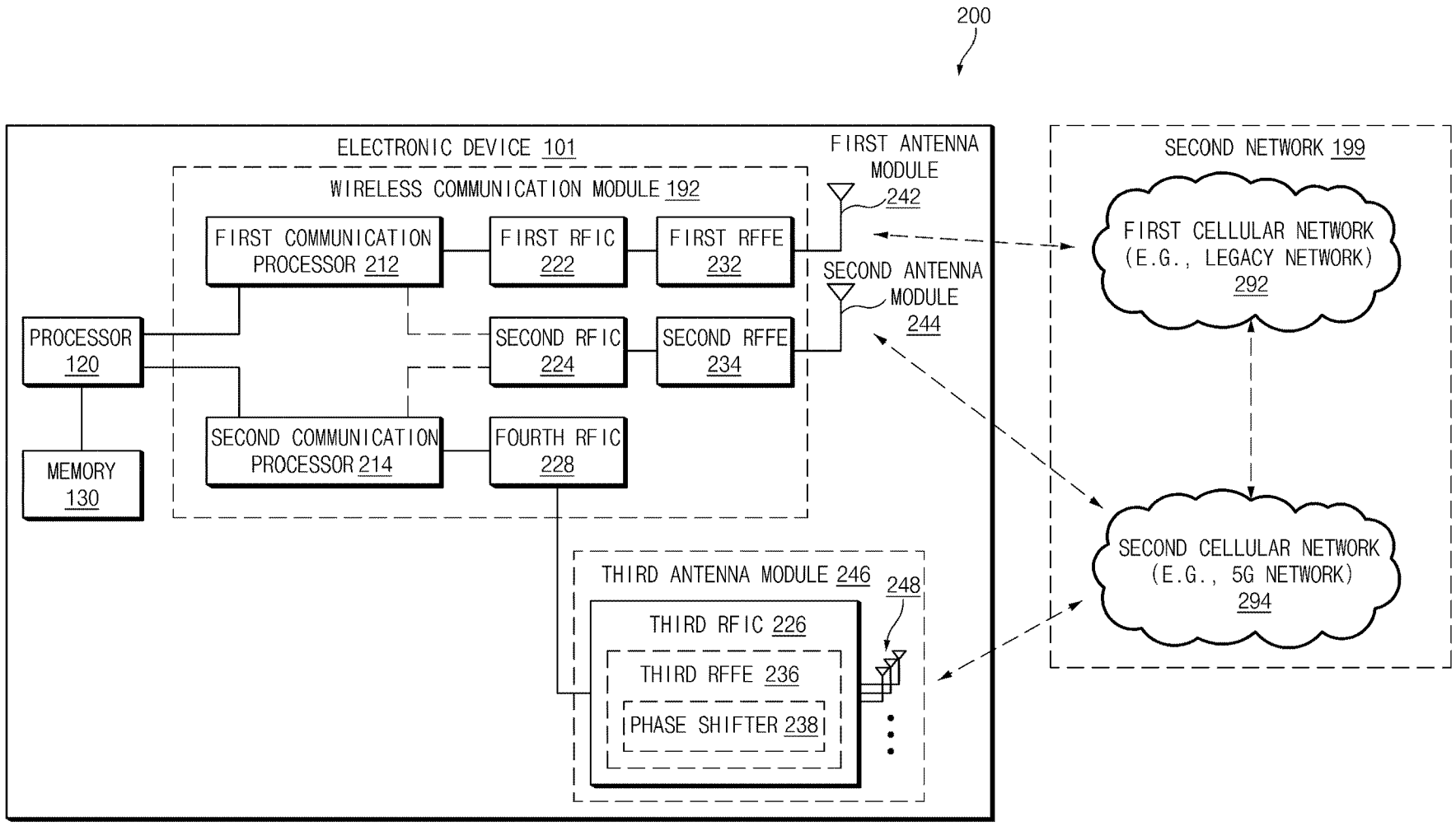
FIG. 2 is a block diagram of an electronic device for supporting legacy network communication and 5G network communication according to an embodiment.

FIG. 2 is a block diagram 200 of the electronic device 101 for supporting legacy network communication and 5G network communication, according to an embodiment. Referring to FIG. 2, the electronic device 101 may include a first communication processor 212, a second communication processor 214, a first radio frequency integrated circuit (RFIC) 222, a second RFIC 224, a third RFIC 226, a fourth RFIC 228, a first radio frequency front end (RFFE) 232, a second RFFE 234, a first antenna module 242, a second antenna module 244, and an antenna 248. The electronic device 101 may further include the processor 120 and the memory 130. The second network 199 may include a first cellular network 292 and a second cellular network 294. According to another embodiment, the electronic device 101 may further include at least one component of the components illustrated in FIG. 1, and the network 199 may further include at least another network. According to an embodiment, the first communication processor 212, the second communication processor 214, the first RFIC 222, the second RFIC 224, the fourth RFIC 228, the first RFFE 232, and the second RFFE 234 may form at least a part of the wireless communication module 192. According to another embodiment, the fourth RFIC 228 may be omitted or may be included as a part of the third RFIC 226.

The first communication processor 212 may establish a communication channel for a band to be used for wireless communication with the first cellular network 292 and may support legacy network communication through the established communication channel. According to certain embodiments, the first cellular network 292 may be a legacy network including 2nd generation (2G), 3G, 4G, or long term evolution (LTE) network. The second communication processor 214 may establish a communication channel corresponding to a specified band (e.g., approximately 6 GHz to approximately 60 GHz) of bands to be used for wireless communication with the second cellular network 294 and may support 5G network communication through the established communication channel. According to an embodiment, the second cellular network 294 may be a 5G network defined in the 3GPP. Additionally, according to an embodiment, the first communication processor 212 or the second communication processor 214 may establish a communication channel corresponding to another specified band (e.g., approximately 6 GHz or lower) of the bands to be used for wireless communication with the second cellular network 294 and may support the 5G network communication through the established communication channel. According to an embodiment, the first communication processor 212 and the second communication processor 214 may be implemented in a single chip or a single package. According to certain embodiments, the first communication processor 212 or the second communication processor 214 may be implemented in a single chip or a single package together with the processor 120, the auxiliary processor 123, or the communication module 190.

In the case of transmitting a signal, the first RFIC 222 may convert a baseband signal generated by the first communication processor 212 into a radio frequency (RF) signal of approximately 700 MHz to approximately 3 GHz that is used in the first cellular network 292 (e.g., a legacy network). In the case of receiving a signal, an RF signal may be obtained from the first cellular network 292 (e.g., a legacy network) through an antenna (e.g., the first antenna module 242) and may be pre-processed through an RFFE (e.g., the first RFFE 232). The first RFIC 222 may convert the pre-processed RF signal into a baseband signal so as to be processed by the first communication processor 212.

In the case of transmitting a signal, the second RFIC 224 may convert a baseband signal generated by the first communication processor 212 or the second communication processor 214 into an RF signal (hereinafter referred to as a "5G Sub6 RF signal") in a Sub6 band (e.g., approximately 6 GHz or lower) used in the second cellular network 294 (e.g., a 5G network). In the case of receiving a signal, a 5G Sub6 RF signal may be obtained from the second cellular network 294 (e.g., a 5G network) through an antenna (e.g., the second antenna module 244) and may be pre-processed through an RFFE (e.g., the second RFFE 234). The second RFIC 224 may convert the pre-processed 5G Sub6 RF signal into a baseband signal so as to be processed by a corresponding communication processor of the first communication processor 212 or the second communication processor 214.

The third RFIC 226 may convert a baseband signal generated by the second communication processor 214 into an RF signal in a 5G Above6 band (hereinafter referred to as a "5G Above6 RF signal," e.g., approximately 6 GHz to approximately 60 GHz) to be used in the second cellular network 294 (e.g., the 5G network). In the case of receiving the signal, the 5G Above6 RF signal may be obtained from the second cellular network 294 (e.g., a 5G network) through an antenna (e.g., the antenna 248) and may be pre-processed through the third RFFE 236. The third RFFE 236 may include a phase shifter 238 that shifts the phase of the received 5G Above6 RF signal. The third RFIC 226 may convert the pre-processed 5G Above6 RF signal into a baseband signal so as to be processed by the second communication processor 214. According to an embodiment, the third RFFE 236 may be implemented as a part of the third RFIC 226.

According to an embodiment, the electronic device 101 may include the fourth RFIC 228 implemented independently of the third RFIC 226 or as at least a part of the third RFIC 226. In this case, the fourth RFIC 228 may convert a baseband signal generated by the second communication processor 214 into an RF signal (hereinafter referred to as an "IF signal") in an intermediate frequency band (e.g., approximately 9 GHz to approximately 11 GHz) and may provide the IF signal to the third RFIC 226. The third RFIC 226 may convert the IF signal into a 5G Above6 RF signal. In the case of receiving a signal, the 5G Above6 RF signal may be received from the second cellular network 294 (e.g., a 5G network) through an antenna (e.g., the antenna 248) and may be converted into an IF signal by the third RFIC 226. The fourth RFIC 228 may convert the IF signal into a baseband signal so as to be processed by the second communication processor 214.

According to an embodiment, the first RFIC 222 and the second RFIC 224 may be implemented as at least a part of a single package or a single chip. According to an embodiment, the first RFFE 232 and the second RFFE 234 may be implemented as at least a part of a single package or a single chip. According to an embodiment, at least one of the first antenna module 242 or the second antenna module 244 may be omitted or may be combined with any other antenna module to process RF signals in a plurality of bands.

According to an embodiment, the third RFIC 226 and the antenna 248 may be disposed on the same substrate to form a third antenna module 246. For example, the wireless communication module 192 or the processor 120 may be disposed on a first substrate (e.g., a main PCB). In this case, the third RFIC 226 may be disposed in a partial region (e.g., on a lower surface) of a second substrate (e.g., a sub PCB) independent of the first substrate, and the antenna 248 may be disposed in another partial region (e.g., on an upper surface) of the second substrate. As such, the third antenna module 246 may be formed. According to an embodiment, the antenna 248 may include, for example, an antenna array capable of being used for beamforming. As the third RFIC 226 and the antenna 248 are disposed at the same substrate, it may be possible to decrease the length of a transmission line between the third RFIC 226 and the antenna 248. For example, the decrease in the transmission line may make it possible to prevent signals in the high-frequency band (e.g., approximately 6 GHz to approximately 60 GHz) used for 5G network communication from being lost (or attenuated) due to the transmission line. As such, the electronic device 101 may improve the quality or speed of communication with the second cellular network 294 (e.g., a 5G network).

The second cellular network 294 (e.g., a 5G network) may be used independently of the first cellular network 292 (e.g., a legacy network) (e.g., this scheme being called "stand-alone (SA)") or may be used in connection with the first cellular network 292 (e.g., this scheme being called "non-stand alone (NSA)"). For example, only an access network (e.g., a 5G radio access network (RAN) or a next generation RAN (NG RAN)) may be present in the 5G network, and a core network (e.g., a next generation core (NGC)) may be absent from the 5G network. In this case, the electronic device 101 may access the access network of the 5G network and may then access an external network (e.g., Internet) under control of a core network (e.g., an evolved packed core (EPC)) of the legacy network. Protocol information (e.g., LTE protocol information) for communication with the legacy network or protocol information (e.g., New Radio (NR) protocol information) for communication with the 5G network may be stored in the memory 130 so as to be accessed by any other component (e.g., the processor 120, the first communication processor 212, or the second communication processor 214). The processor 120 may include a microprocessor or any suitable type of processing circuitry, such as one or more general-purpose processors (e.g., ARM-based processors), a Digital Signal Processor (DSP), a Programmable Logic Device (PLD), an Application-Specific Integrated Circuit (ASIC), a Field-Programmable Gate Array (FPGA), a Graphical Processing Unit (GPU), a video card controller, etc. In addition, it would be recognized that when a general purpose computer accesses code for implementing the processing shown herein, the execution of the code transforms the general purpose computer into a special purpose computer for executing the processing shown herein. Certain of the functions and steps provided in the Figures may be implemented in hardware, software or a combination of both and may be performed in whole or in part within the programmed instructions of a computer. No claim element herein is to be construed under the provisions of 35 U.S.C. § 112(f), unless the element is expressly recited using the phrase "means for." In addition, an artisan understands and appreciates that a "processor" or "microprocessor" may be hardware in the claimed disclosure. Under the broadest reasonable interpretation, the appended claims are statutory subject matter in compliance with 35 U.S.C. § 101.

FIGS. 3(*a*) to 3(*c*) illustrate an embodiment of the third antenna module 246 described with reference to FIG. 2, for example. FIG. 3(*a*) is a perspective view of the third antenna module 246 when viewed from one side, and FIG. 3(*b*) is a perspective view of the third antenna module 246 when viewed from another side. FIG. 3(*c*) is a cross-sectional view of the third antenna module 246 taken along line A-A' of FIG. 3(*a*).

Referring to FIGS. 3(*a*) to 3(*c*), in an embodiment, the third antenna module 246 may include a printed circuit board 310, an antenna array 330, a radio frequency integrated circuit (RFIC) 352, and a power manage integrated circuit (PMIC) 354. In addition, the third antenna module 246 may further include a shielding member 390. In other embodiments, at least one of the above components may be omitted, or at least two of the above components may be integrated.

The printed circuit board 310 may include a plurality of conductive layers and a plurality of non-conductive layers, and the conductive layers and the non-conductive layers may be alternately stacked. The printed circuit board 310 may provide an electrical connection between various electronic components disposed on the printed circuit board 310 or disposed on the surface of the printed circuit board 310, by using wires and conductive vias formed in the conductive layers.

The antenna array 330 (e.g., 248 of FIG. 2) may include a plurality of antenna elements 332, 334, 336, and 338 disposed to be able to form a directional beam. The antenna elements 332, 334, 336, and 338 may be formed on a first surface of the printed circuit board 310 as illustrated. According to another embodiment, the antenna array 330 may be formed within the printed circuit board 310. According to another embodiment, the antenna array 330 may include a plurality of antenna arrays (e.g., dipole antenna array and/or patch antenna array) that are identical or different in shape or kind.

The RFIC 352 (e.g., 226 of FIG. 2) may be disposed in another region (e.g., on a second surface facing away from the first surface) of the printed circuit board 310 so as to be spaced from the antenna array 330. The RFIC 352 is configured to process signals in a selected frequency band, which is transmitted/received through the antenna array 330. According to an embodiment, in the case of transmitting a signal, the RFIC 352 may convert a baseband signal obtained from a communication processor (not illustrated) into an RF signal in a specified band. In the case of receiving a signal, the RFIC 352 may convert an RF signal received through the antenna array 330 into a baseband signal and may provide the baseband signal to the communication processor.

According to another embodiment, in the case of transmitting a signal, the RFIC 352 may up-convert an IF signal (e.g., approximately 9 GHz to approximately 11 GHz) obtained from an intermediate frequency integrated circuit (IFIC) (e.g., 228 of FIG. 2) into an RF signal in a selected band. In the case of receiving a signal, the RFIC 352 may down-convert an RF signal obtained through the antenna array 330 into an IF signal and may provide the IF signal to the IFIC.

The PMIC 354 may be disposed in the other region (e.g., on the second surface) of the printed circuit board 310, which is spaced from the antenna array 330. The PMIC 354 may be supplied with a voltage from a main PCB (not illustrated) and may provide the power necessary for various components (e.g., the RFIC 352) on the antenna module 246.

The shielding member 390 may be disposed at a portion (e.g., on the second surface) of the printed circuit board 310 such that at least one of the RFIC 352 or the PMIC 354 is electromagnetically shielded. According to an embodiment, the shielding member 390 may be a shield can.

Although not illustrated, in other embodiments, the third antenna module 246 may be electrically connected with another printed circuit board (e.g., a main circuit board) through a module interface. The module interface may include a connection member, for example, coaxial cable connector, board to board connector, interposer, or flexible printed circuit board (FPCB). The RFIC 352 and/or the PMIC 354 of the antenna module 246 may be disposed on the main circuit board and be electrically connected with the printed circuit board 310 through the connection member.

Figure 4:
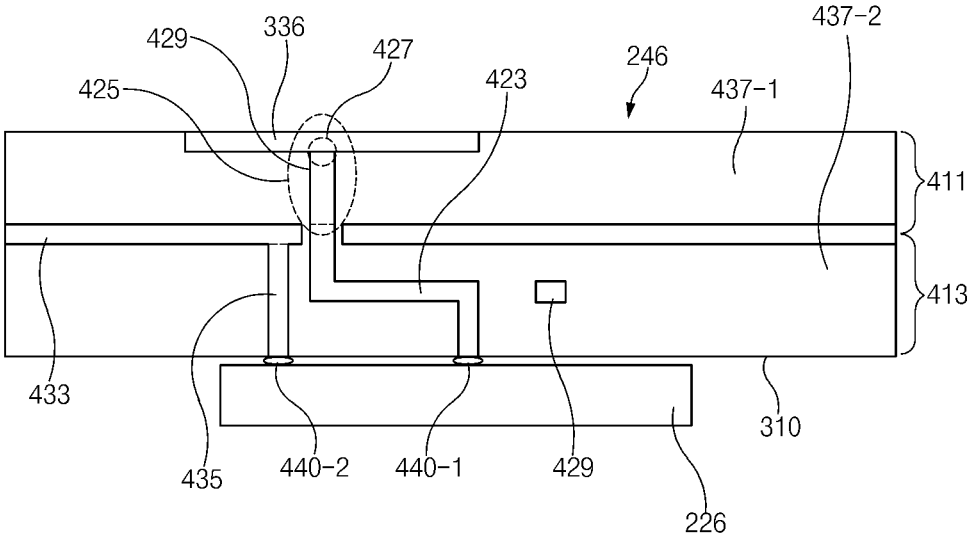
FIG. 4 illustrates a cross-sectional view of a third antenna module taken along line A-A' of FIG. 3(*a*)

FIG. 4 illustrates a cross-sectional view of the third antenna module 246 taken along line A-A' of FIG. 3(*a*). In an embodiment illustrated, the printed circuit board 310 may include an antenna layer 411 and a network layer 413.

The antenna layer 411 may include at least one dielectric layer 437-1, and an antenna element 336 and/or a feeding part 425 formed on an outer surface of the dielectric layer 437-1 or therein. The feeding part 425 may include a feeding point 427 and/or a feeding line 429.

The network layer 413 may include at least one dielectric layer 437-2, at least one ground layer 433, at least one conductive via 435, a transmission line 423, and/or a signal line 429 formed on an outer surface of the dielectric layer 437-2 or therein.

In addition, in the embodiment illustrated, the third RFIC 226 of FIG. 2 may be electrically connected with the network layer 413, for example, through first and second connection parts (e.g., solder bumps) 440-1 and 440-2. In other embodiments, various connection structures (e.g., soldering or a ball grid array (BGA)) may be utilized instead of the particular connection part illustrated. The third RFIC 226 may be electrically connected with the antenna element 336 through the first connection part 440-1, the transmission line 423, and the feeding part 425. Also, the third RFIC 226 may be electrically connected with the ground layer 433 through the second connection part 440-2 and the conductive via 435. Although not illustrated, the third RFIC 226 may also be electrically connected with the above module interface through the signal line 429.

Figure 5:
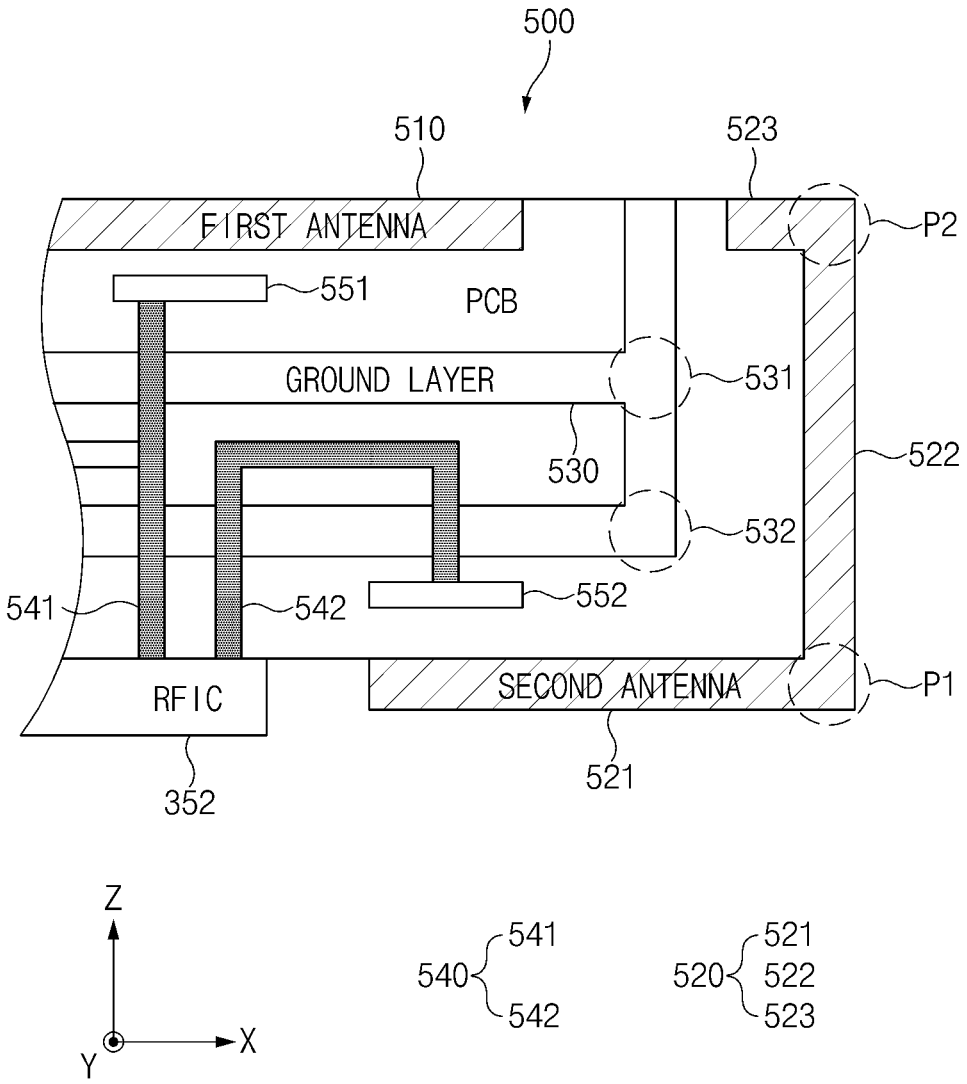
FIG. 5 is a cross-sectional view of an antenna module according to an embodiment.

FIG. 5 is a cross-sectional view of an antenna module 500 according to an embodiment. The antenna module 500 according to an embodiment may include a first antenna 510, a second antenna 520, at least one ground layer 530, and a wire 540. FIG. 5 illustrates the case where the antenna module 500 is formed of one PCB having a plurality of layers. However, the disclosure is not so limited. For example, the antenna module 500 may be implemented by combining a plurality of PCBs. In such an example, the antenna module 500 may include a first PCB including the first antenna 510 and a second PCB including the second antenna 520.

In an embodiment, the PCB may include a first surface, a second surface, and a third surface. The first surface may face a first direction. The first direction may be the direction in which the first antenna 510 is disposed. For example, the first direction may be the positive direction of the Z-axis, as shown in FIG. 5. The second surface may face a second direction that is opposite to the first direction. For example, the second direction may be the negative direction of the Z-axis. The third direction may be a direction that is perpendicular to the first direction and the second direction. For example, the third direction may be the positive direction of the X-axis.

In an embodiment, the first antenna 510 may be disposed on the first surface. The first antenna 510 may be implemented with a metal layer at a layer of the PCB including the first surface or with a metal pattern at the layer including the first surface. The first antenna 510 may be a patch antenna. The first antenna 510 may radiate signals. For example, the first antenna 510 may form a beam pattern having straightness in the first direction.

In an embodiment, the second antenna 520 may include a first portion 521, a second portion 522, and a third portion 523. The first portion 521 may be disposed on the second surface. The first portion 521 may be disposed to at least partially overlap the first antenna 510 when viewed in the second direction.

In an embodiment, the second portion 522 may be disposed adjacent to the third surface. For example, as illustrated in FIG. 5, the second portion 522 may be disposed on the third surface so as to be disposed on the outside of the PCB. However, the disclosure is not limited thereto. For example, the second portion 522 may be disposed within the PCB so as to be adjacent to the third surface.

In an embodiment, the second portion 522 may be extended from a first point P1 of the first portion 521 in the first direction. The first point P1 may be a location that does not overlap the first antenna 510 on the second surface when viewed in the second direction. The first point P1 may be a location that is adjacent to the third surface. For example, as illustrated in FIG. 5, the first point P1 may be a vertex at which the second surface and the third surface intersect. However, the disclosure is not so limited. For example, the first point P1 may be a location that is adjacent to the third surface on the second surface. The second portion 522 may be extended from the first point P1 on the second surface to the first surface.

In an embodiment, the third portion 523 may be extended to face the first antenna 510 from a second point P2 of the second portion 522. The second point P2 may be spaced apart from the first antenna 510 on the first surface. The second point P2 may be a location that is adjacent to the third surface. For example, as illustrated in FIG. 5, the second point P2 may be a vertex at which the first surface and the third surface intersect. However, the disclosure is not so limited. For example, the second point P2 may be a location that is adjacent to the third surface on the first surface. The third portion 523 may be extended from the second point P2 on the first surface to face the first antenna 510. The third portion 523 may be spaced from the first antenna 510.

In an embodiment, the first portion 521 and the third portion 523 of the second antenna 520 may be implemented with a metal layer at a layer including the first surface and the second surface or with a metal pattern at the layer including the first surface and the second surface. The second portion 522 of the second antenna 520 may be implemented with a metal pattern formed along the third surface or with a conductive via formed within the PCB so as to be adjacent to the third surface. The second antenna 520 may be a patch antenna having the structure of being bent at at least one point. For example, the second antenna 520 may have the structure of being bent at the first point P1 and the second point P2. The second antenna 520 may radiate signals in a direction between the first direction, the second direction, and/or the third direction. For example, the second antenna 520 may form a beam pattern having straightness in a direction between the first direction, the second direction, and/or the third direction.

In an embodiment, the at least one ground layer 530 may be interposed between the first antenna 510 and the second antenna 520. The at least one ground layer 530 may be disposed at one or more layers present in the PCB. For example, the at least one ground layer 530 may be a conductive layer that is formed by using three layers of the PCB. The at least one ground layer 530 may be extended in the third direction.

In an embodiment, the at least one ground layer 530 may include a bending portion (531, 532). The bending portion (531, 532) may be bent to extend in the first direction from the third direction. The at least one ground layer 530 may be extended from the bending portion (531, 532) so as to face the first surface. For example, as illustrated in FIG. 5, the at least one ground layer 530 may be extended to the first surface. However, the disclosure is not so limited. For example, the at least one ground layer 530 may be extended from the bending portion (531, 532) so as to be adjacent to the first surface.

In an embodiment, the at least one wire 540 may be connected with the RFIC 352. The at least one wire 540 may transfer signals received from the RFIC 352 to the first antenna 510 and the second antenna 520 in order to feed the first antenna 510 and the second antenna 520. The at least one wire 540 may separately feed the first antenna 510 and the second antenna 520. For example, a first wire 541 of the at least one wire 540 may feed the first antenna 510, and a second wire 542 of the at least one wire 540 may feed the second antenna 520.

In an embodiment, as illustrated in FIG. 5, the at least one wire 540 may include the first wire 541 connected with a first conductive pattern 551 disposed adjacent to the first antenna 510 and the second wire 542 connected with a second conductive pattern 552 disposed adjacent to the second antenna 520. The first conductive pattern 551 may be coupled with the first antenna 510, and the second conductive pattern 552 may be coupled with the second antenna 520. The at least one wire 540 may indirectly feed the first antenna 510 and the second antenna 520 by using the first conductive pattern 551 and the second conductive pattern 552. However, the disclosure is not so limited. For example, the at least one wire 540 may be directly connected with the first antenna 510 and the second antenna 520.

In an embodiment, the first antenna 510 and at least a portion of the first portion 521 except for the first point P1 of the second antenna 520 may overlap each other when viewed in the second direction. The region of the first portion 521 of the second antenna 520 overlapping the first antenna 510 may form a beam pattern in the first direction, the second direction, the third direction, and/or a direction therebetween. How the first antenna 510 and the second antenna 520 form the beam pattern will be more fully described with reference to FIG. 9.

In an embodiment, the first antenna 510 and the second portion 522 of the second antenna 520 may be disposed to be spaced from each other in the third direction. The second portion 522 may be disposed in the third direction (i.e. the positive direction of the X-axis) with respect to the first antenna 510 to prevent the first antenna 510 and the second antenna 520 from contacting each other or from causing mutual interference.

In an embodiment, at least a portion of the at least one ground layer 530 may be interposed between the first antenna 510 and the second portion 522 of the second antenna 520. The at least one ground layer 530 may perform the role of setting a reference voltage of the first antenna 510 and the second antenna 520. The at least one ground layer 530 may electrically separate the first antenna 510 from the second portion 522 of the second antenna 520.

In an embodiment, the first antenna 510 may form a first beam pattern facing the first direction. The first antenna 510 may radiate the signal in the first direction or may receive an external signal transmitted in the first direction.

In an embodiment, the second antenna 520 may form a second beam pattern facing a direction between the first direction, the second direction, and/or the third direction. The second beam pattern may be formed in various directions depending on the shape of the second antenna 520. For example, the direction of the second beam pattern may be determined depending on the location of the first point P1 at which the second antenna 520 is bent toward the first surface. In another example, the direction of the second beam pattern may be determined depending on the location of the second point P2 of the second antenna 520, at which the second antenna 520 is bent toward the first antenna 510. In yet another example, the direction of the second beam pattern may be determined depending on the sizes of the first portion 521, the second portion 522, and/or the third portion 523 of the second antenna 520.

Figure 6:
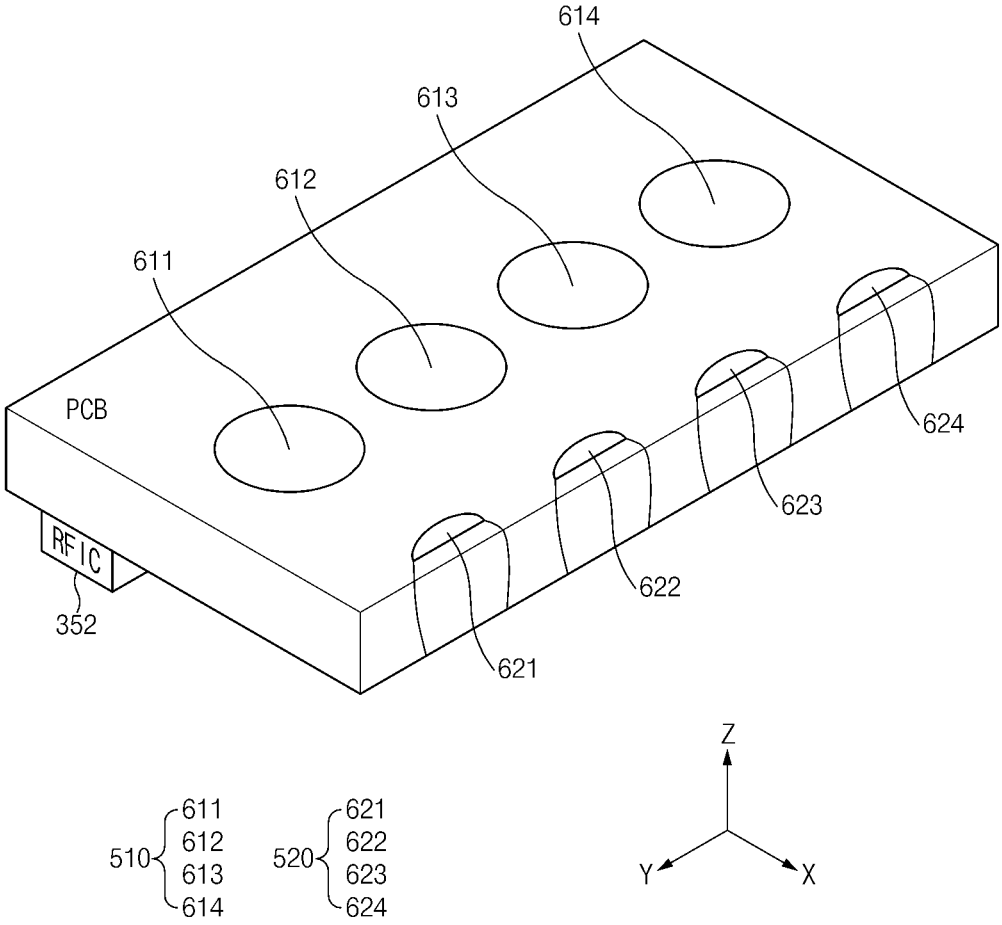
FIG. 6 is a perspective view of an antenna module according to an embodiment.

FIG. 6 is a perspective view of an antenna module according to an embodiment. An antenna module according to an embodiment may include a PCB and the RFIC 352 connected with one side (or surface) of the PCB.

In an embodiment, the first antenna 510 including first to fourth patches 611, 612, 613, and 614 may be disposed on the first surface of the PCB. The first surface of the PCB may be a surface that faces the first direction. The first direction may be the positive direction of the Z-axis, as shown in FIG. 6. The first to fourth patches 611, 612, 613, and 614 may constitute an array antenna. The first to fourth patches 611, 612, 613, and 614 may form a first beam pattern in the first direction.

In an embodiment, the second antenna 520 includes fifth to eighth patches 621, 622, 623, and 624 that are disposed on the third surface from the second surface of the PCB and are bent to face the first to fourth patches, respectively. The fifth to eighth patches 621, 622, 623, and 624 may be extended from the second surface while being bent to be adjacent to the third surface. At least a portion of each of the fifth to eighth patches 621, 622, 623, and 624 may be exposed on the first surface. The second surface may face the second direction being the negative direction of the Z-axis. The third surface may face the third direction being the positive direction of the X-axis. The fifth to eighth patches 621, 622, 623, and 624 may at least partially overlap the first to fourth patches 611, 612, 613, and 614 when viewed in the Z-axis direction (the overlapping is not shown in FIG. 6). The fifth to eighth patches 621, 622, 623, and 624 may form a second beam pattern in a direction between the first direction, the second direction, and/or the third direction.

In an embodiment, the RFIC 352 may feed the first antenna 510 and the second antenna 520. The RFIC 352 may feed a first signal to the first antenna 510 and may feed a second signal different in phase from the first signal to the second antenna 520. For example, the difference between the phase of the first signal fed to the first antenna 510 by the RFIC 352 and the phase of the second signal fed to the second antenna 520 by the RFIC 352 may be 180 degrees. By using signals of different phases, the first antenna 510 and the second antenna 520 may form and/or steer a beam pattern in the first direction, the second direction, the third direction, and/or any direction different from the first direction, the second direction, and the third direction. As such, the antenna module according to an embodiment may form and/or steer beam patterns in 360 degrees by using the first antenna 510 and the second antenna 520 formed on one PCB.

Figure 7:
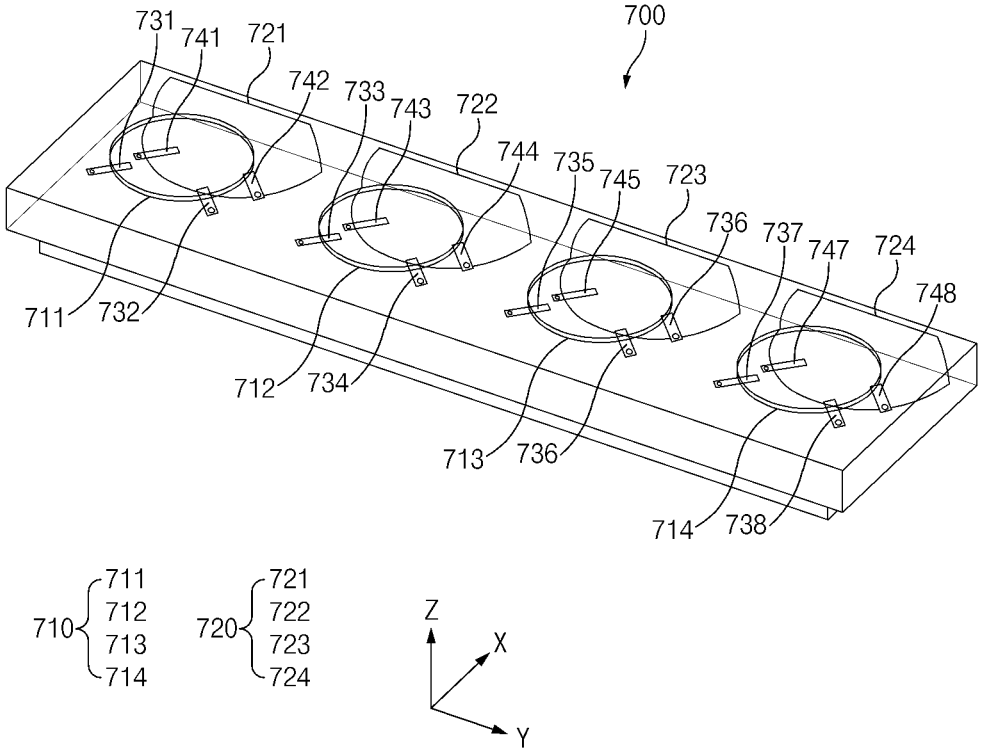
FIG. 7 is a perspective view illustrating feeding terminals of an antenna module according to an embodiment.

FIG. 7 is a perspective view illustrating feeding terminals 731, 732, 733, 734, 735, 736, 737, 738, 741, 742, 743, 744, 745, 746, 747, and 748 of an antenna module 700 according to an embodiment.

In an embodiment, the antenna module 700 may include a first antenna 710 that includes first to fourth patches 711, 712, 713, and 714 and a second antenna 720 that includes fifth to eighth patches 721, 722, 723, and 724. The first to fourth patches 711, 712, 713, and 714 may be disposed on the first surface facing the positive direction of the Z-axis (i.e. the first direction). The fifth to eighth patches 721, 722, 723, and 724 may have the following structure: bent from the second surface facing the negative direction of the Z-axis (i.e. the second direction) to the third surface facing the third direction being the positive direction of the X-axis and then again bent to the first surface.

In an embodiment, each of the first to fourth patches 711, 712, 713, and 714 and the fifth to eighth patches 721, 722, 723, and 724 may be connected with two feeding terminals. For example, the first patch 711 may be connected with the first and second feeding terminals 731 and 732. The second patch 712 may be connected with the third and fourth feeding terminals 733 and 734. The third patch 713 may be connected with the fifth and sixth feeding terminals 735 and 736. The fourth patch 714 may be connected with the seventh and eighth feeding terminals 737 and 738. The fifth patch 721 may be connected with the ninth and tenth feeding terminals 741 and 742. The sixth patch 722 may be connected with the eleventh and twelfth feeding terminals 743 and 744. The seventh patch 723 may be connected with the thirteenth and fourteenth feeding terminals 745 and 7436. And finally, the eighth patch 724 may be connected with the fifteenth and sixteenth feeding terminals 747 and 748.

In an embodiment, each of the first to eighth patches 711, 712, 713, 714, 721, 722, 723, and 724 may be fed from one of the two feeding terminals (this scheme called "single feed") or from both feeding terminals (this scheme called "dual-feed"). In the case of the dual-feed scheme, each of the first to eighth patches 711, 712, 713, 714, 721, 722, 723, and 724 may be fed with signals of different phases from the two feeding terminals.

In an embodiment, in the case where each of the first to eighth patches 711, 712, 713, 714, 721, 722, 723, and 724 is fed with signals of different phases from the two feeding terminals, current flows formed on the first to eighth patches 711, 712, 713, 714, 721, 722, 723, and 724 may be differently formed by the corresponding feeding terminals. For example, the first antenna 710 may include the first, third, fifth, and seventh feeding terminals 731, 733, 735, and 737 performing first feeding on the first antenna 710 so as to form a first current parallel to the first surface, and the second, fourth, sixth, and eighth feeding terminals 732, 734, 736, and 738 performing second feeding on the first antenna 710 so as to form a second current parallel to the first surface and perpendicular to the first current.

In an embodiment, in the case where the dual-feed scheme is applied to the first antenna 710 and the second antenna 720, which in this case are patch antennas disposed on two surfaces, it may be possible to implement wide coverage of the antenna. Each of the first to eighth patches 711, 712, 713, 714, 721, 722, 723, and 724 included in the first antenna 710 and the second antenna 720 may include at least two or more feeding terminals. The two or more feeding terminals connected with each of the first to eighth patches 711, 712, 713, 714, 721, 722, 723, and 724 may control the coverage as patches facing each other are fed in a synchronization manner (e.g. at the same time).

Figure 8:
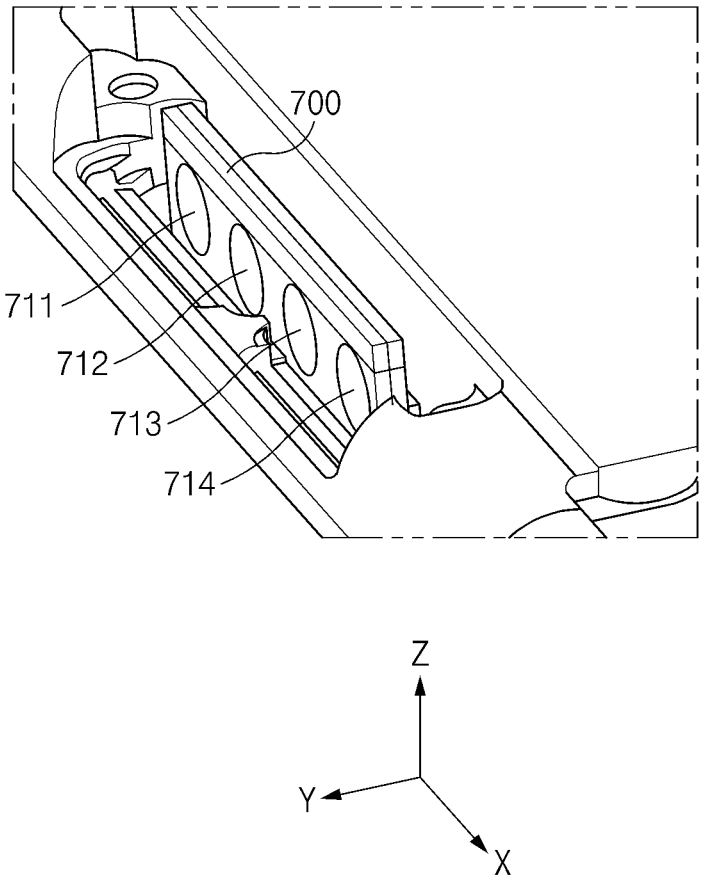
FIG. 8 is a diagram illustrating an electronic device in an antenna module according to an embodiment is included.

FIG. 8 is a diagram illustrating an electronic device (e.g., the electronic device 101 of FIG. 1) in which the antenna module 700 according to an embodiment is included.

In an embodiment, the electronic device 101 may include a housing and the antenna module 700. The housing may include a front plate, a back plate facing away from the front plate, and a side member formed in a space between the front plate and the back plate, and at least a portion of the side member may be made of a conductive material. For example, the housing may include the front plate facing the positive direction of the Z-axis being the first direction, the back plate facing the negative direction of the Z-axis being the second direction, and the side member facing the positive direction of the X-axis, the negative direction of the X-axis, the positive direction of the Y-axis, and the negative direction of the Y-axis.

In the embodiment, the antenna module 700 may be disposed within the housing. The antenna module 700 may include a first surface, a second surface parallel to the first surface, and a third surface connecting the first surface and the second surface. For example, in the case where a radiation part of the antenna module 700 is disposed adjacent to the side member of an electronic device, the antenna module 700 may include a first surface that faces the positive direction of the Y-axis and is disposed adjacent to the side member, a second surface that faces the negative direction of the Y-axis and is disposed to face away from the side member, and a third surface that is disposed adjacent to the front plate and/or the back plate. However, the disclosure is not so limited. For example, the radiation part of the antenna module 700 may be disposed adjacent to the front plate and/or the back plate. In this case, the first surface may be disposed adjacent to the front plate and/or the back plate of the electronic device 101, and the third surface may be disposed adjacent to the side member of the electronic device 101.

In an embodiment, a first antenna (e.g., the first antenna 710 of FIG. 7) including the first to fourth patches 711, 712, 713, and 714 may be disposed on the first surface. A second antenna (e.g., the second antenna 720 of FIG. 7) may be extended from the second surface while being bent to be disposed on the third surface and may be extended from the third surface while being bent to face the first antenna 710 on the first surface.

In an embodiment, at least one ground layer (e.g., the ground layer 530 of FIG. 5) may include a bending portion (e.g., the bending portion (531, 532)) that is interposed between the first antenna 710 and the second antenna 720 and is bent in a shape corresponding to the second antenna 720.

In an embodiment, an RFIC (e.g., the RFIC 352 of FIG. 5) may be disposed adjacent to the second surface. The RFIC 352 may feed a first signal to the first to fourth patches 711, 712, 713, and 714 and may feed a second signal different in phase from the first signal to the second antenna 520.

In an embodiment, at least one wire (e.g., the wire 540 of FIG. 5) connecting the first antenna 710 and the second antenna 720 with the RFIC 352 may be further included. The at least one wire 540 may have a structure capable of supplying signals of different phases to the first antenna 710 and the second antenna 720. For example, the at least one wire 540 may be directly connected with the first antenna 710 and the second antenna 720 to perform direct feeding on the first antenna 710 and the second antenna 720. For another example, the at least one wire 540 may be connected with conductive patterns (e.g., the conductive patterns 551 and 552 of FIG. 5) adjacent to the first antenna 710 and the second antenna 720 to perform indirect feeding by using a phenomenon where the conductive patterns 551 and 552 are coupled with the first antenna 710 and the second antenna 720.

In an embodiment, the second antenna 520 may be disposed to be spaced from the RFIC 352. When the second antenna 520 overlaps the RFIC 352 on the second surface, the beam pattern that the second antenna 520 forms may be distorted. As such, the second antenna 520 may be spaced from the RFIC 352.

Figure 9:
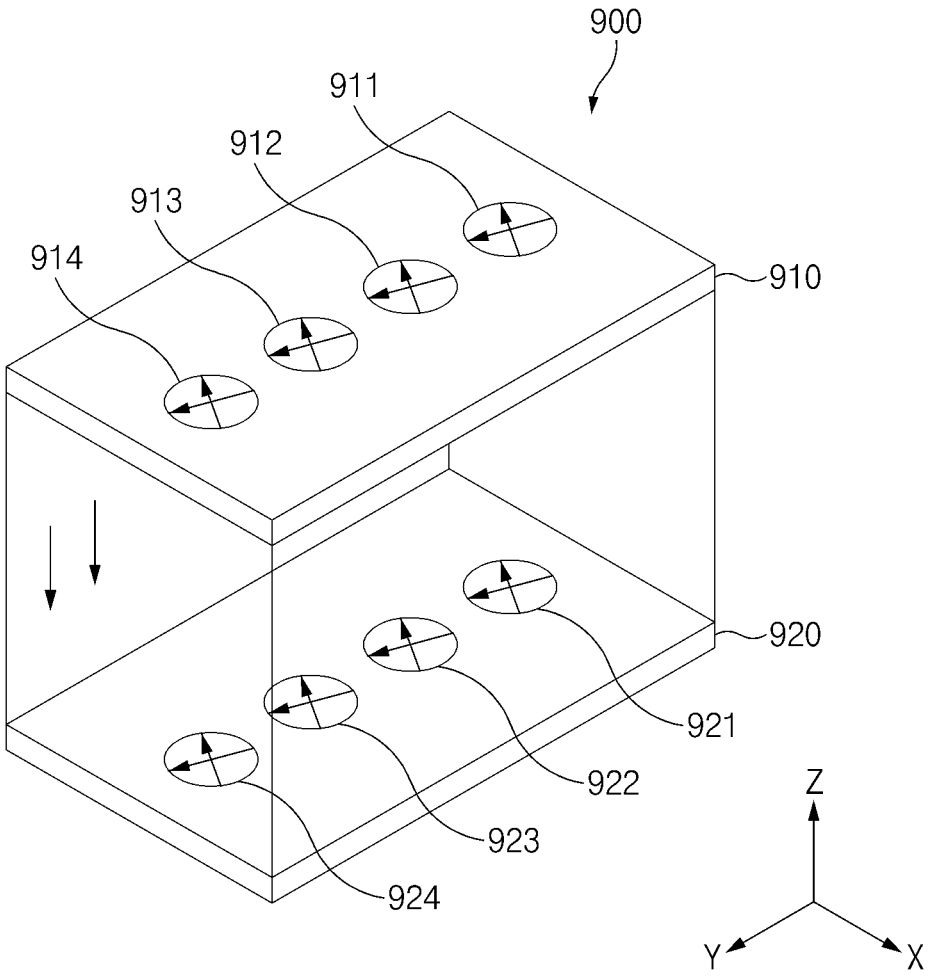
FIG. 9 is a diagram illustrating how currents flow at a first PCB layer and a second PCB layer of an antenna module and a side surface of an antenna module, according to an embodiment.

FIG. 9 is a diagram illustrating how currents flow at a first PCB layer 910 and a second PCB layer 920 of an antenna module 900 and a side surface of the antenna module 900, according to an embodiment.

In an embodiment, the first PCB layer 910 may face the positive direction of the Z-axis being the first direction. The first PCB layer 910 may include first to fourth patches 911, 912, 913, and 914 constituting a first antenna (e.g., the first antenna 510 of FIG. 5). The second PCB layer 920 may face the negative direction of the Z-axis being the second direction. The second PCB layer 920 may include fifth to eighth patches 921, 922, 923, and 924 constituting a second antenna (e.g., the second antenna 520 of FIG. 5).

In an embodiment, the first to fourth patches 911, 912, 913, and 914 may constitute a dual polarization patch antenna having a first polarization and a second polarization forming angles of +45 degrees and −45 degrees with the X-axis and the Y-axis on an XY plane perpendicular to the first direction and the second direction. The fifth to eighth patches 921, 922, 923, and 924 may constitute a dual polarization patch antenna having a third polarization and a fourth polarization forming angles of −45 degrees and +45 degrees with the X-axis and the Y-axis on the XY plane perpendicular to the first direction and the second direction. The first polarization to the fourth polarization may operate as a vertical polarization.

In an embodiment, the fifth to eighth patches 921, 922, 923, and 924 may have a phase difference of 180 degrees with the first to fourth patches 911, 912, 913, and 914. As such, the first to fourth patches 911, 912, 913, and 914 may form a first beam pattern including a main beam formed in the first direction, and the fifth to eighth patches 921, 922, 923, and 924 may form a second beam pattern including a main beam formed in the second direction.

In an embodiment, the first to fourth patches 911, 912, 913, and 914 may operate independently of the fifth to eighth patches 921, 922, 923, and 924. As such, dual-polarization operation may be implemented.

Figure 10A:
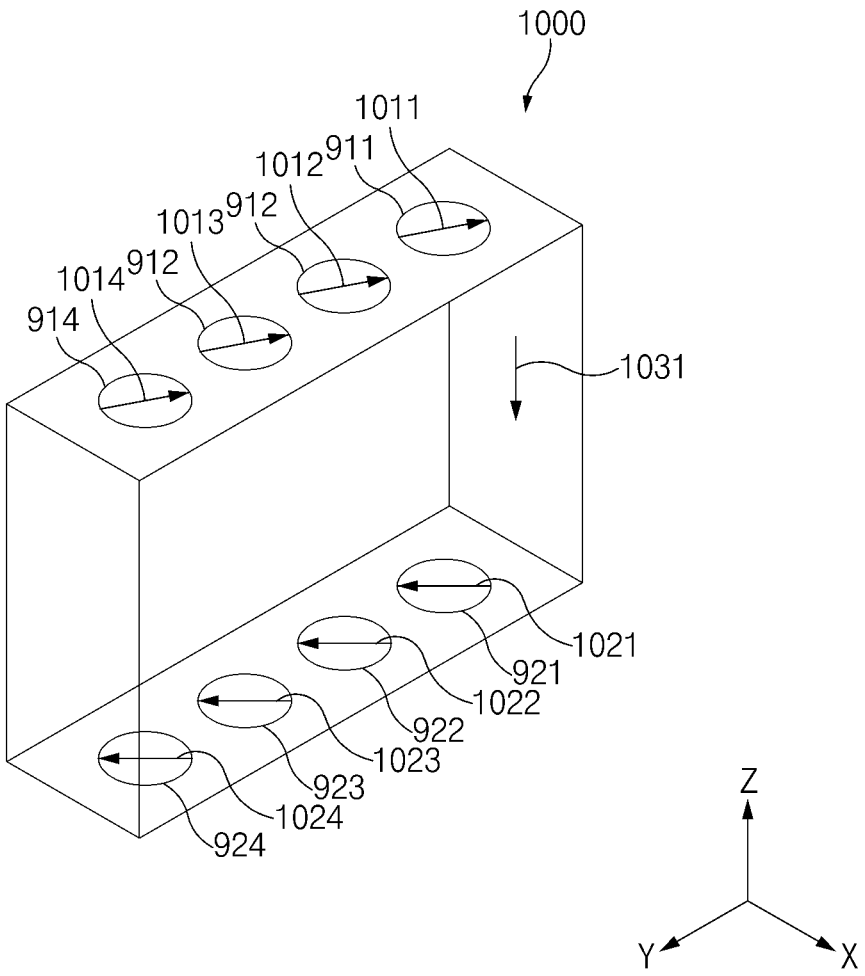
FIG. 10A is a diagram illustrating how currents flow at a first antenna and a second antenna of an antenna module and a side surface of the antenna module, according to an embodiment.
Figure 10B:
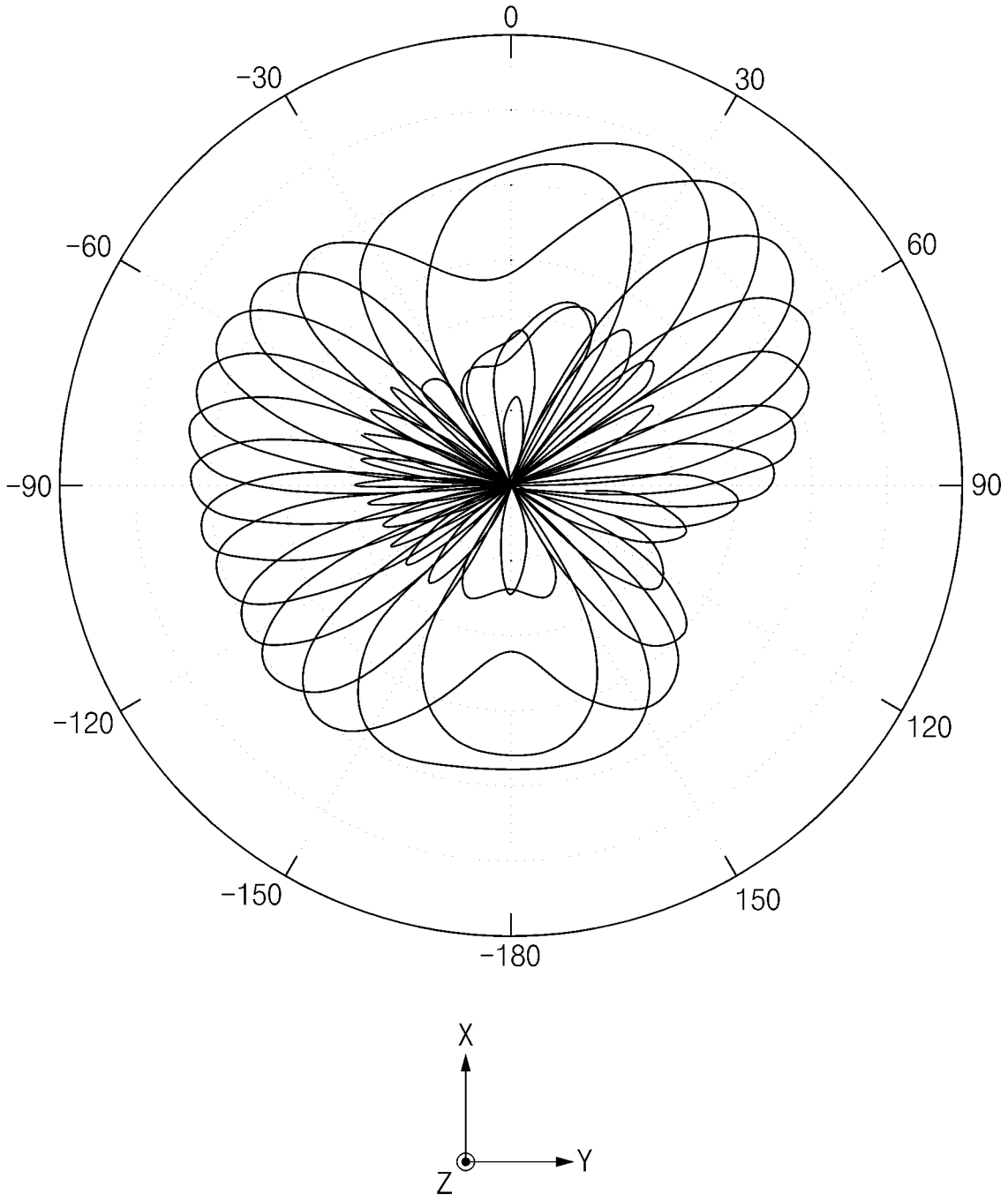
FIG. 10B is a diagram illustrating a beam pattern that an antenna module according to an embodiment forms.

FIG. 10A is a diagram illustrating current flows at a first antenna (911, 912, 913, 914) and a second antenna (921, 922, 923, 924) of an antenna module 1000 and a current flow 1031 at a side surface of the antenna module 1000, according to an embodiment. FIG. 10B is a diagram illustrating a beam pattern that the antenna module 1000 according to an embodiment forms.

In an embodiment, current flows 1011, 1012, 1013, 1014, 1021, 1022, 1023, and 1024 may be formed at the first antenna (911, 912, 913, 914) and the second antenna (921, 922, 923, 924). For example, the first to fourth current flows 1011, 1012, 1013, and 1014 may be formed at the first antenna (911, 912, 913, 914). The first to fourth current flows 1011, 1012, 1013, and 1014 may form a first beam pattern in the first direction. The fifth to eighth current flows 1021, 1022, 1023, and 1024 may be formed at the second antenna (921, 922, 923, 924). The fifth to eighth current flows 1021, 1022, 1023, and 1024 may form a second beam pattern in the second direction.

In an embodiment, the current flow 1031 at the side surface of the antenna module 1000 may be formed uniformly in the second direction. As such, the current flow 1031 at the side surface of the antenna module 1000 may allow a third beam pattern to be formed in a lateral direction that is the third direction.

In an embodiment, with reference to the positive direction of the X-axis on the XY plane, which is the third direction, only polarization portions inclined at +45 degrees may be activated at the first to fourth patches 911, 912, 913, and 914 constituting the first antenna and the fifth to eighth patches 921, 922, 923, and 924 constituting the second antenna. In this case, compared to the case of being polarized at a reference angle, the first beam pattern and the second beam pattern may be formed in a state of being inclined at +45 degrees. As such, it may be confirmed that a beam pattern is strongly formed in directions of +45 degrees and −135 degrees.

Figure 11A:
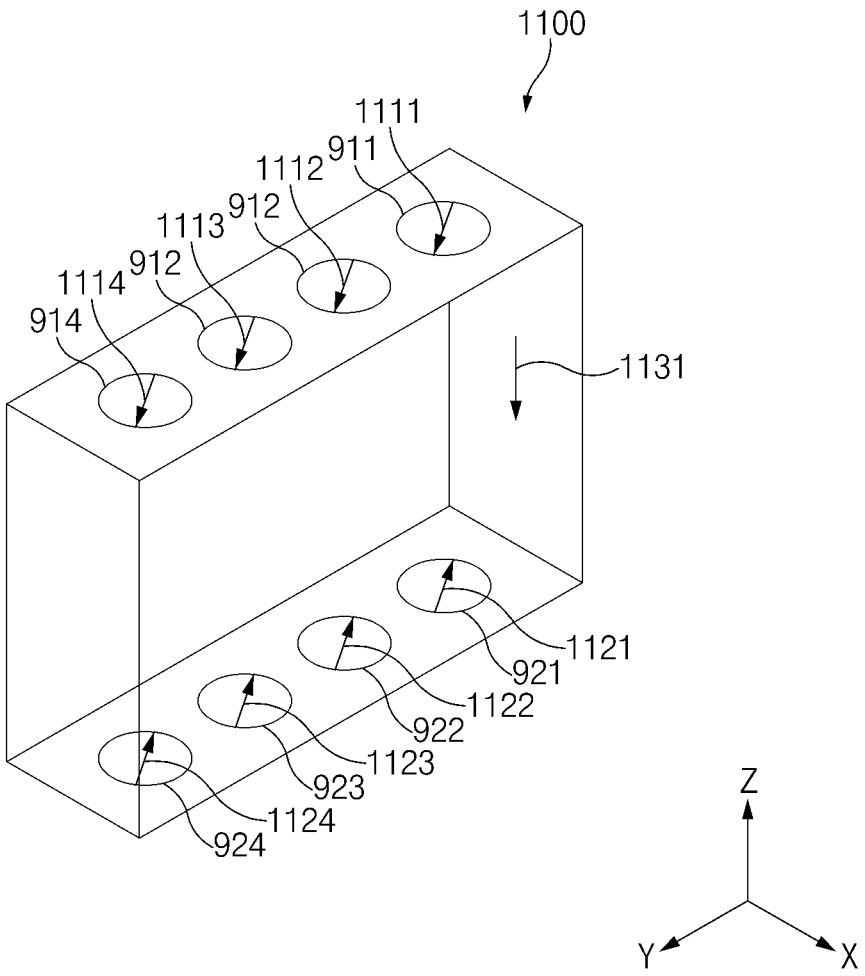
FIG. 11A is a diagram illustrating how currents flow at a first antenna and a second antenna of an antenna module and a side surface of the antenna module, according to an embodiment.
Figure 11B:
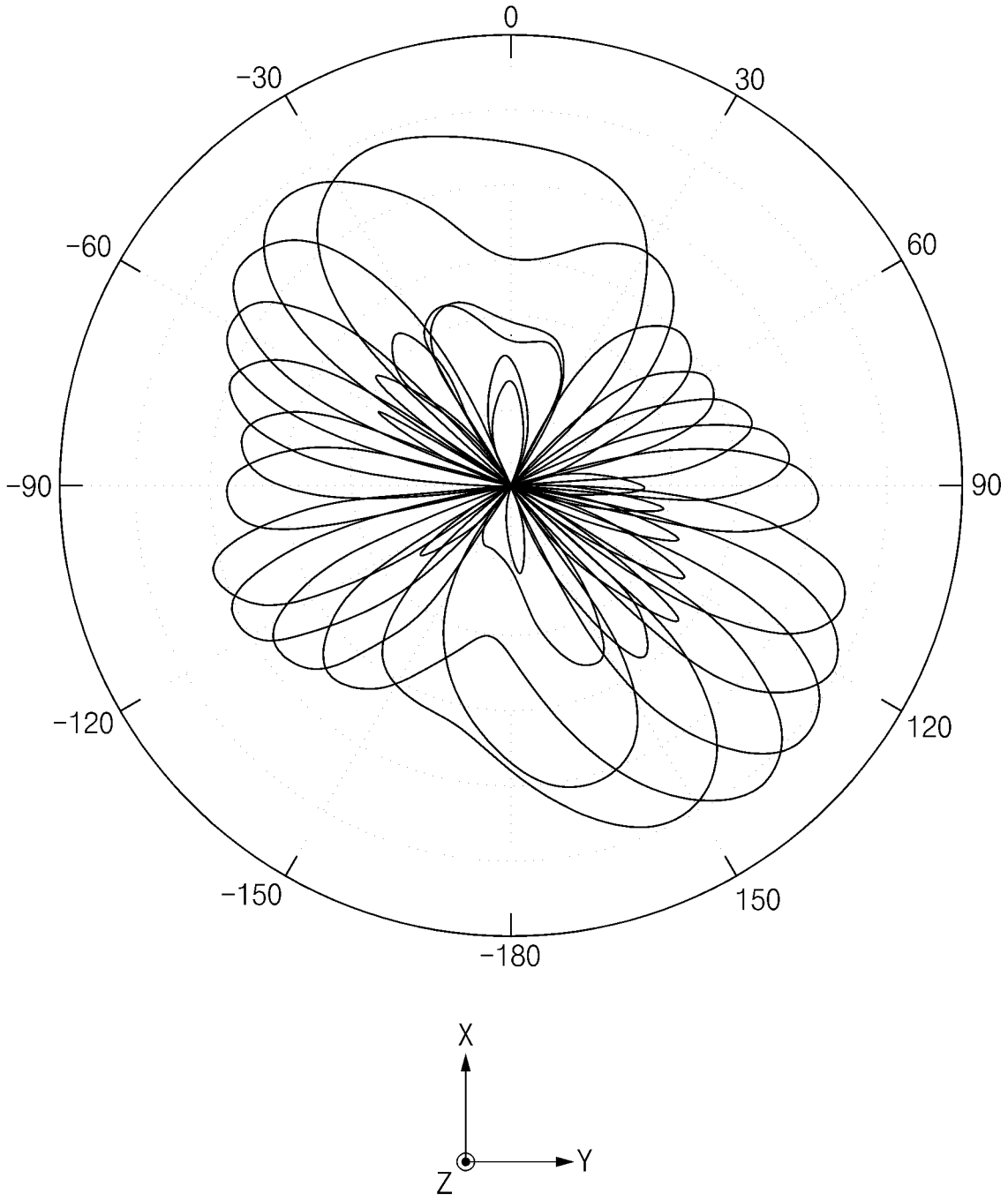
FIG. 11B is a diagram illustrating a beam pattern that an antenna module according to an embodiment forms.

FIG. 11A is a diagram illustrating current flows at the first antenna (911, 912, 913, 914) and the second antenna (921, 922, 923, 924) of an antenna module 1100 and a current flow 1131 at a side surface of the antenna module 1100, according to an embodiment. FIG. 11B is a diagram illustrating a beam pattern that an antenna module according to an embodiment forms.

In an embodiment, current flows 1111, 1112, 1113, 1114, 1121, 1122, 1123, and 1124 may be formed at the first antenna (911, 912, 913, 914) and the second antenna (921, 922, 923, 924). For example, the ninth to twelfth current flows 1111, 1112, 1113, and 1114 may be formed at the first antenna (911, 912, 913, 914). The ninth to twelfth current flows 1111, 1112, 1113, and 1114 may form a first beam pattern in the first direction. The thirteenth to sixteenth current flows 1121, 1122, 1123, and 1124 may be formed at the second antenna (921, 922, 923, 924). The thirteenth to sixteenth current flows 1121, 1122, 1123, and 1124 may form a second beam pattern in the second direction.

In an embodiment, the current flow 1131 at the side surface of the antenna module 1100 may be formed uniformly in the second direction. As such, the current flow 1131 at the side surface of the antenna module 1100 may allow a third beam pattern to be formed in a lateral direction that is the third direction.

In an embodiment, with reference to the positive direction of the X-axis on the XY plane, which is the third direction, only polarization portions inclined at −45 degrees may be activated at the first to fourth patches 911, 912, 913, and 914 constituting the first antenna and the fifth to eighth patches 921, 922, 923, and 924 constituting the second antenna. In this case, compared to the case of being polarized at a reference angle, the first beam pattern and the second beam pattern may be formed in a state of being inclined at −45 degrees. As such, it may be confirmed that a beam pattern is strongly formed in directions of −45 degrees and +135 degrees.

Figure 12A:
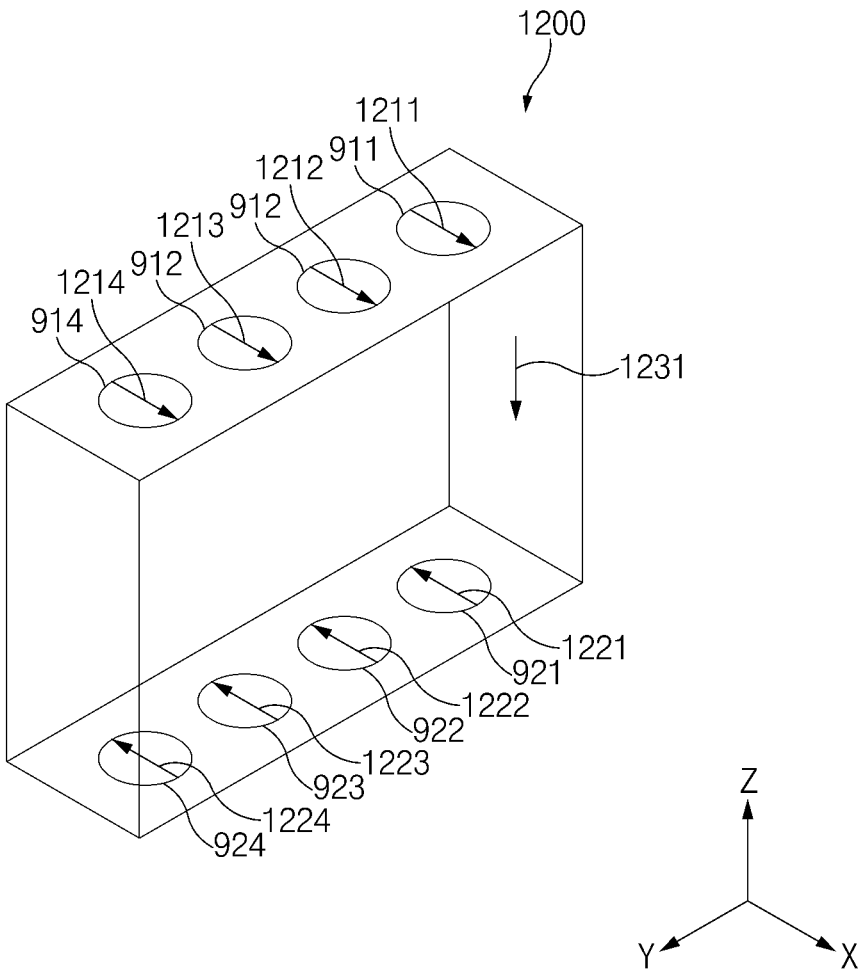
FIG. 12A is a diagram illustrating how currents flow at a first antenna and a second antenna of a PCB and a side surface of an antenna module, according to an embodiment.

FIG. 12A is a diagram illustrating how currents flow at a first antenna and a second antenna of a PCB and a side surface of an antenna module, according to an embodiment.

Figure 12B:
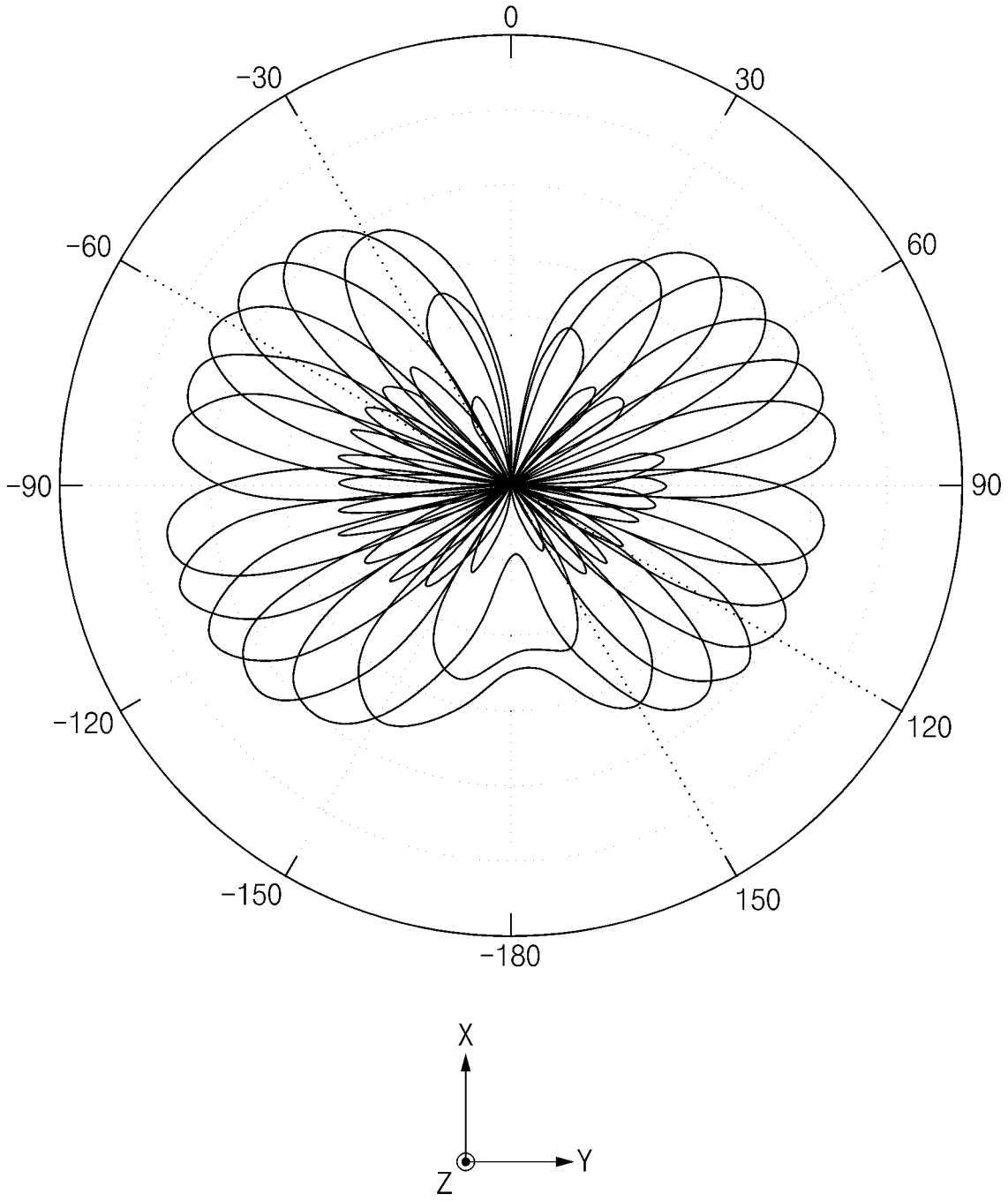
FIG. 12B is a diagram illustrating a beam pattern that an antenna module according to an embodiment forms.

FIG. 12B is a diagram illustrating a beam pattern that an antenna module according to an embodiment forms.

In an embodiment, current flows 1211, 1212, 1213, 1214, 1221, 1222, 1223, and 1224 may be formed at the first antenna (911, 912, 913, 914) and the second antenna (921, 922, 923, 924). For example, the seventeenth to twentieth current flows 1211, 1212, 1213, and 1214 may be formed at the first antenna (911, 912, 913, 914). The seventeenth to twentieth current flows 1211, 1212, 1213, and 1214 may form a first beam pattern in the first direction. The twentieth-first to twentieth-fourth current flows 1221, 1222, 1223, and 1224 may be formed at the second antenna (921, 922, 923, 924). The twentieth-first to twentieth-fourth current flows 1221, 1222, 1223, and 1224 may form a second beam pattern in the second direction.

In an embodiment, the current flow 1231 at the side surface of an antenna module 1200 may be formed uniformly in the second direction. As such, the current flow 1231 at the side surface of the antenna module 1200 may allow a third beam pattern to be formed in a lateral direction that is the third direction.

In an embodiment, with reference to the positive direction of the X-axis on the XY plane, which is the third direction, all dual-polarization portions inclined at +45 degrees and −45 degrees may be activated at the first to fourth patches 911, 912, 913, and 914 constituting the first antenna and the fifth to eighth patches 921, 922, 923, and 924 constituting the second antenna. In this case, it may be confirmed that a beam pattern is formed to be substantially identical to beam steering of a state in which polarization is formed only in the third direction.

Figure 13:
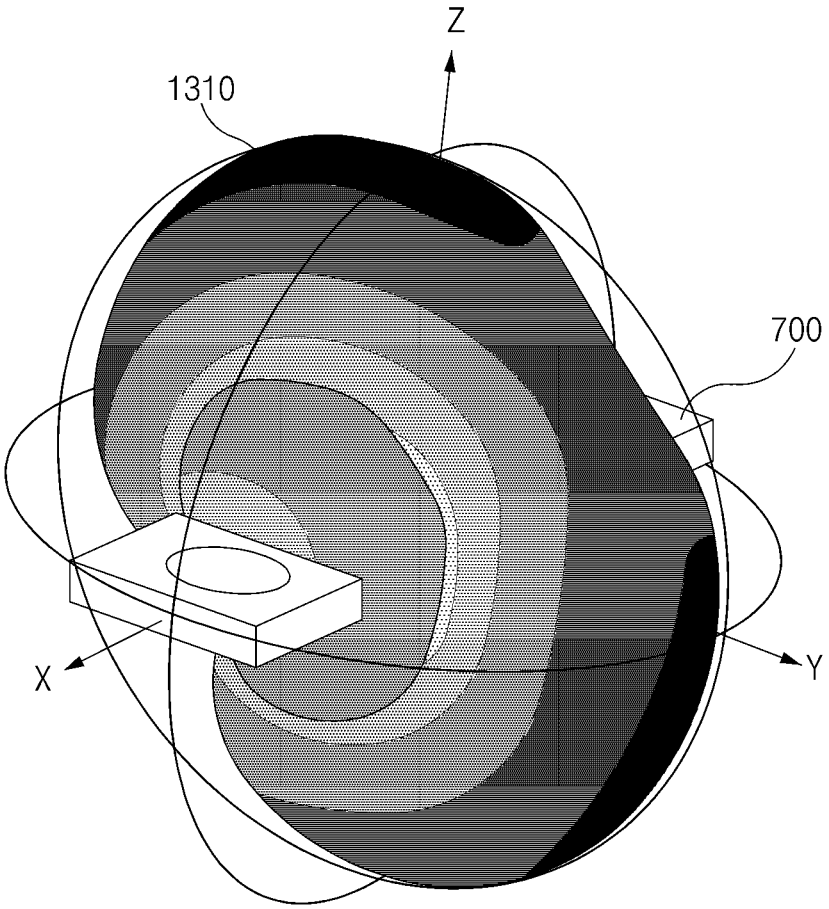
FIG. 13 is a diagram illustrating a beam pattern that an antenna module according to an embodiment forms.

FIG. 13 is a diagram illustrating a beam pattern 1310 that the antenna module 700 according to an embodiment forms.

In an embodiment, it may be confirmed that the beam pattern 1310 is formed in all directions including the positive direction of the Z-axis being the first direction of the antenna module 700, the negative direction of the Z-axis being the second direction of the antenna module 700, and the positive direction of the Y-axis perpendicular to the first direction and the second direction. The antenna module 700 according to an embodiment may feed signals of different phases to a first antenna (e.g., the first antenna 710 of FIG. 7) and a second antenna (e.g., the second antenna 720 of FIG. 7) to increase the arrival angle range of the beam pattern 1310. The antenna module 700 may have an end-fire mode that is characterized in that radiation is focused in an axial direction of the beam arrival angle range. In the end-fire mode, phases of signals fed to the first antenna 710 and the second antenna 720 have a difference of 180 degrees. In the end-fire mode, the beam pattern 1310 may progress as a vertical polarization regardless of polarization. In a broadside mode, the beam pattern 1310 may progress in a dual-polarized state.

In an embodiment, directions of a first beam pattern formed by the first antenna 710 and a second beam pattern formed by the second antenna 720 may be determined depending on a first delay being a delay time of a first signal of the first antenna 710 and/or a second delay being a delay time of a second signal of the second antenna 720. The first delay and the second delay may be determined depending on an internal circuit design of the antenna module 700 and/or sizes and/or shapes of the first antenna 710 and the second antenna 720. In the case where the first delay and the second delay are different, the first beam pattern and the second beam pattern may be combined, and thus, a beam pattern may be steered in various directions.

In an embodiment, directions of the first beam pattern and the second beam pattern may be determined depending on a first length being an electrical length of the first wire and/or a second length being an electrical length of the second wire. In the case where the first length and the second length are different, a first phase being the phase of the first signal fed to the first antenna 710 and a second phase being the phase of the second signal fed to the second antenna 720 may be different. In the case where the first phase and the second phase are different, the first beam pattern and the second beam pattern may be combined, and thus, a beam pattern may be steered in various directions.

Figure 14:
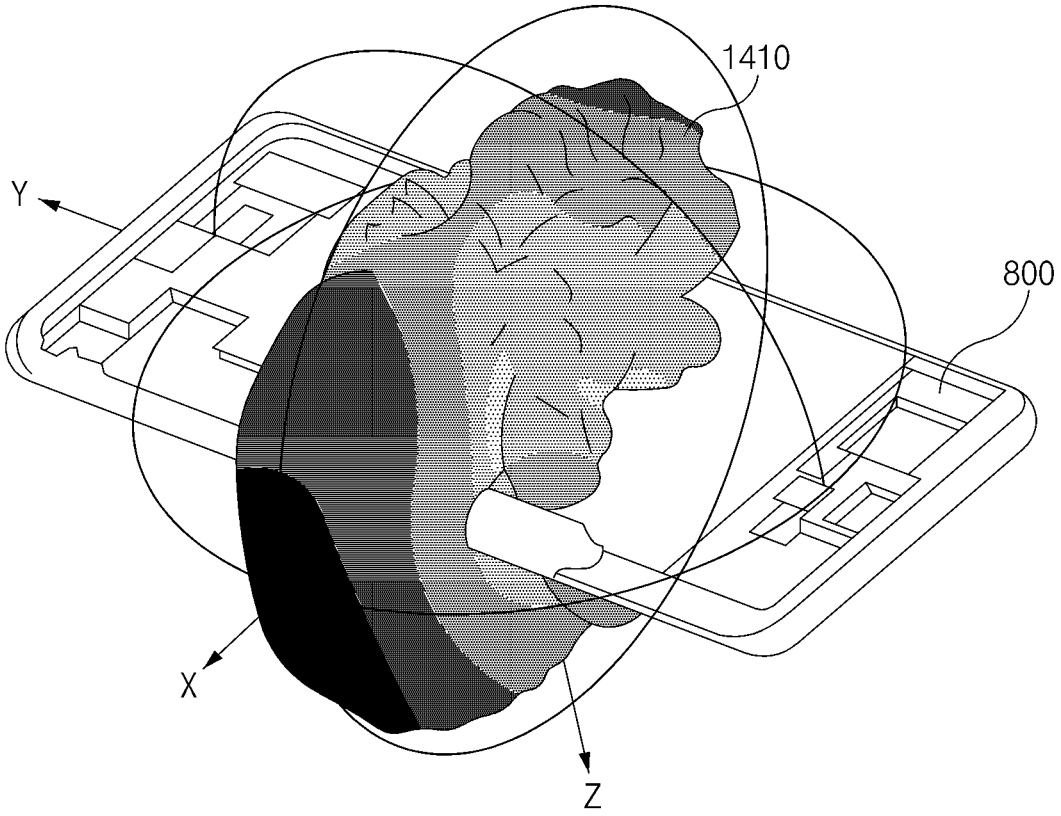
FIG. 14 is a diagram illustrating a beam pattern that an antenna module according to an embodiment forms at an electronic device in which the antenna module is included.

FIG. 14 is a diagram illustrating a beam pattern 1410 that an antenna module (e.g., the antenna module 700 of FIG. 7) according to an embodiment forms at an electronic device 800 in which the antenna module 700 is included.

In an embodiment, in the end-fire mode, the antenna module 700 may additionally form the beam pattern 1410 horizontally polarized in the third direction. For example, a horizontal polarization component may be added by further forming a dipole antenna on a third surface of the electronic device 800, which faces the third direction. In another example, a hole may be formed within a second antenna (e.g., the second antenna 720 of FIG. 7), and a third antenna may be implemented on the third surface by using the hole. In this case, the third antenna may form a third beam pattern facing a direction between the first direction, the second direction, and/or the third direction.

In an embodiment, a first antenna (e.g., the first antenna 710 of FIG. 7) and the second antenna 720 may have an asymmetrically arranged structure when mounted in the electronic device 800. The first antenna 710 and the second antenna 720 may have a patch antenna structure in which the first antenna 710 and the second antenna 720 at least partially overlap each other. Antennas may be simultaneously mounted on opposite surfaces of the antenna module 700 while mounting a 5G IC chip, such as an RFIC (e.g., the RFIC 352 of FIG. 5), on one surface of the antenna module 700. One or more patches constituting the first antenna 710 and the second antenna 720 may form an array antenna. The array antenna may be implemented on two or more surfaces, and one or more feeding terminals and/or a chain such as a wire may be connected with each of patches constituting the array antenna.

In an embodiment, the beam pattern 1410 that is dual-polarized and has large width may be formed at the electronic device 800 in which the antenna module 700 is mounted. Even in the case where signals fed to the first antenna 710 and the second antenna 720 are in phase, the electronic device 800 may radiate the beam pattern 1410 in the end-fire mode.

Figure 15A:
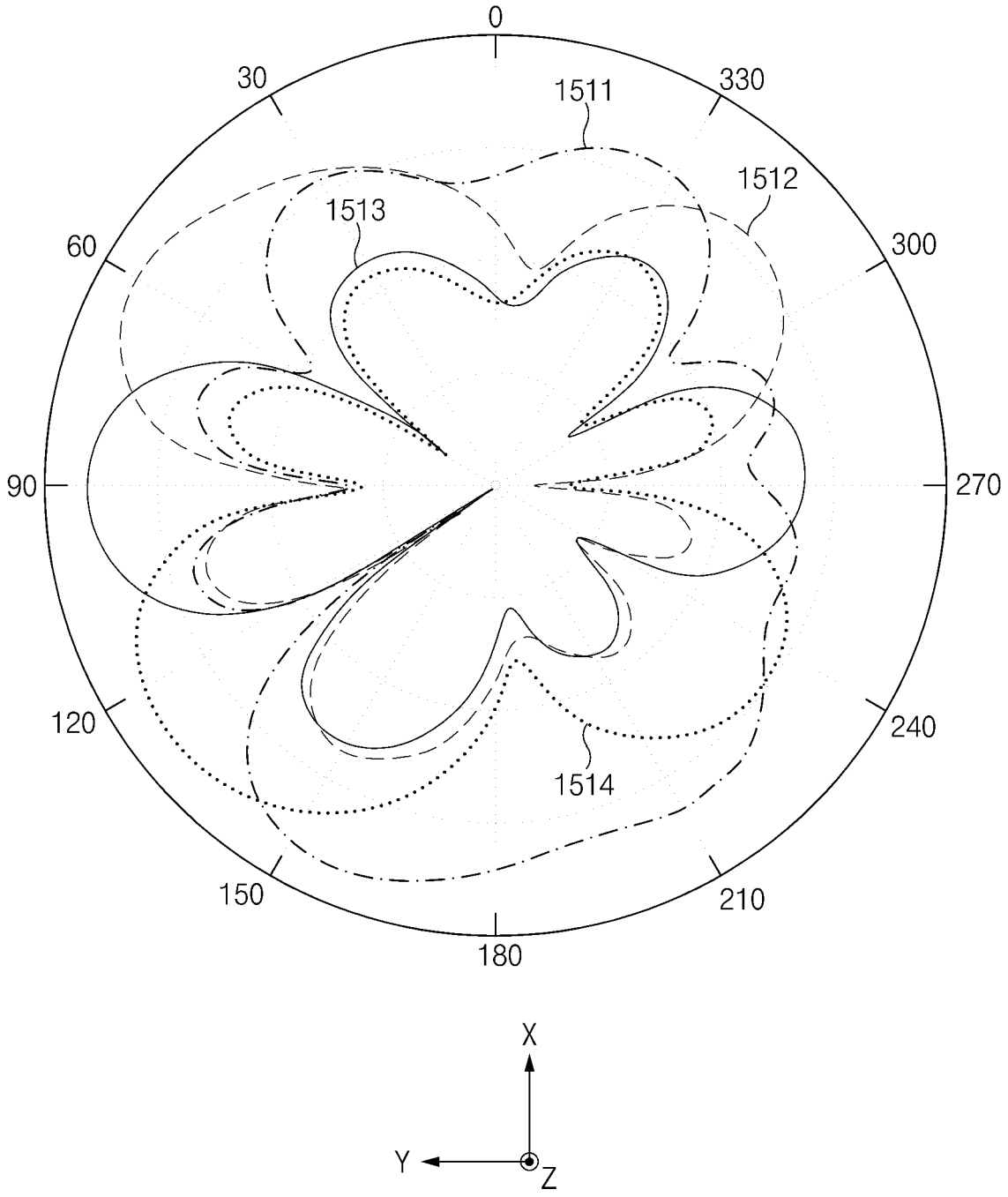
FIG. 15A is a diagram illustrating a beam pattern that an antenna module according to an embodiment forms when a first feeding terminal, a third feeding terminal, a fifth feeding terminal, and a seventh feeding terminal are fed.

FIG. 15A is a diagram illustrating beam patterns 1511, 1512, 1513, and 1514 that an antenna module (e.g., the antenna module 700 of FIG. 7) according to an embodiment forms when a first feeding terminal (e.g., the first feeding terminal 731 of FIG. 7), a third feeding terminal (e.g., the third feeding terminal 733 of FIG. 7), a fifth feeding terminal (e.g., the fifth feeding terminal 735 of FIG. 7), and a seventh feeding terminal (e.g., the seventh feeding terminal 737 of FIG. 7) are fed.

In an embodiment, the first to fourth beam patterns 1511, 1512, 1513, and 1514 may be classified depending on phase differences. For example, the first beam pattern 1511 may be a beam pattern corresponding to the case where the phase difference of a first antenna (e.g., the first antenna 710 of FIG. 7) and a second antenna (e.g., the second antenna 720 of FIG. 7) is 180 degrees. In another example, the second beam pattern 1512 may be a beam pattern corresponding to the case where the phase difference of the first antenna 710 and the second antenna 720 is 270 degrees. In yet another example, the third beam pattern 1513 may be a beam pattern corresponding to the case where the phase difference of the first antenna 710 and the second antenna 720 is 0 degree. In still yet another example, the fourth beam pattern 1514 may be a beam pattern corresponding to the case where the phase difference of the first antenna 710 and the second antenna 720 is 90 degrees. In the case where the first, third, fifth, and seventh feeding terminals 731, 733, 735, and 737 are fed, the first to fourth beam patterns 1511, 1512, 1513, and 1514 may be steered to be biased in the negative direction of the X-axis.

Figure 15B:
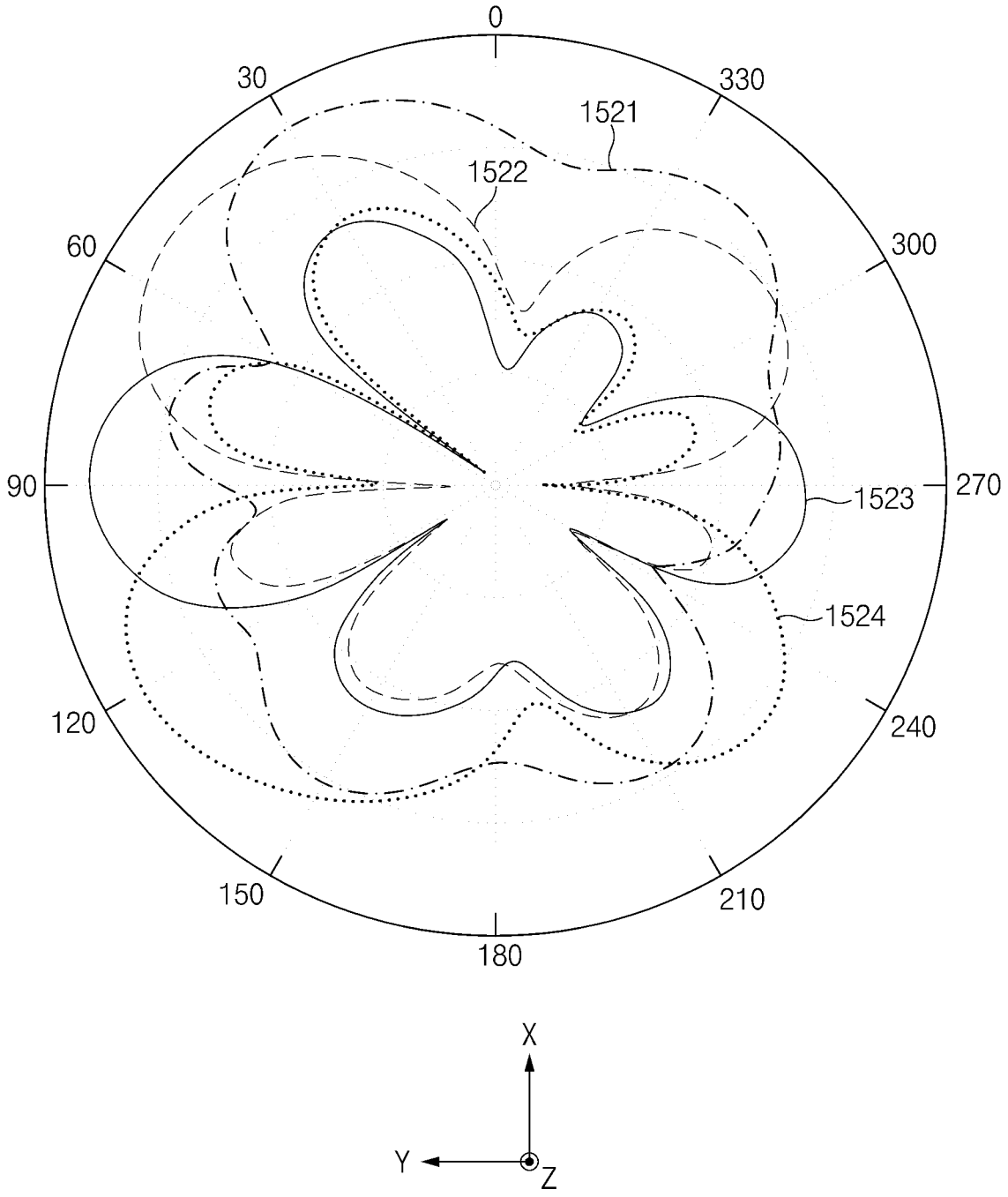
FIG. 15B is a diagram illustrating a beam pattern that an antenna module according to an embodiment forms when a second feeding terminal, a fourth feeding terminal, a sixth feeding terminal, and an eighth feeding terminal are fed.

FIG. 15B is a diagram illustrating beam patterns 1521, 1522, 1523, and 1524 that an antenna module (e.g., the antenna module 700 of FIG. 7) according to an embodiment forms when a second feeding terminal (e.g., the second feeding terminal 732 of FIG. 7), a fourth feeding terminal (e.g., the fourth feeding terminal 734 of FIG. 7), a sixth feeding terminal (e.g., the sixth feeding terminal 736 of FIG. 7), and an eighth feeding terminal (e.g., the eighth feeding terminal 738 of FIG. 8) are fed.

In an embodiment, the fifth to eighth beam patterns 1521, 1522, 1523, and 1524 may be classified depending on phase differences. For example, the fifth beam pattern 1521 may be a beam pattern corresponding to the case where the phase difference of the first antenna 710 and the second antenna 720 is 180 degrees. In another example, the sixth beam pattern 1522 may be a beam pattern corresponding to the case where the phase difference of the first antenna 710 and the second antenna 720 is 270 degrees. In yet another example, the seventh beam pattern 1523 may be a beam pattern corresponding to the case where the phase difference of the first antenna 710 and the second antenna 720 is 0 degree. In still yet another example, the eighth beam pattern 1524 may be a beam pattern corresponding to the case where the phase difference of the first antenna 710 and the second antenna 720 is 90 degrees. In the case where the second, fourth, sixth, and eighth feeding terminals 732, 734, 736, and 738 are fed, the fifth to eighth beam patterns 1521, 1522, 1523, and 1524 may be steered to be biased in the positive direction of the X-axis.

Figure 15C:
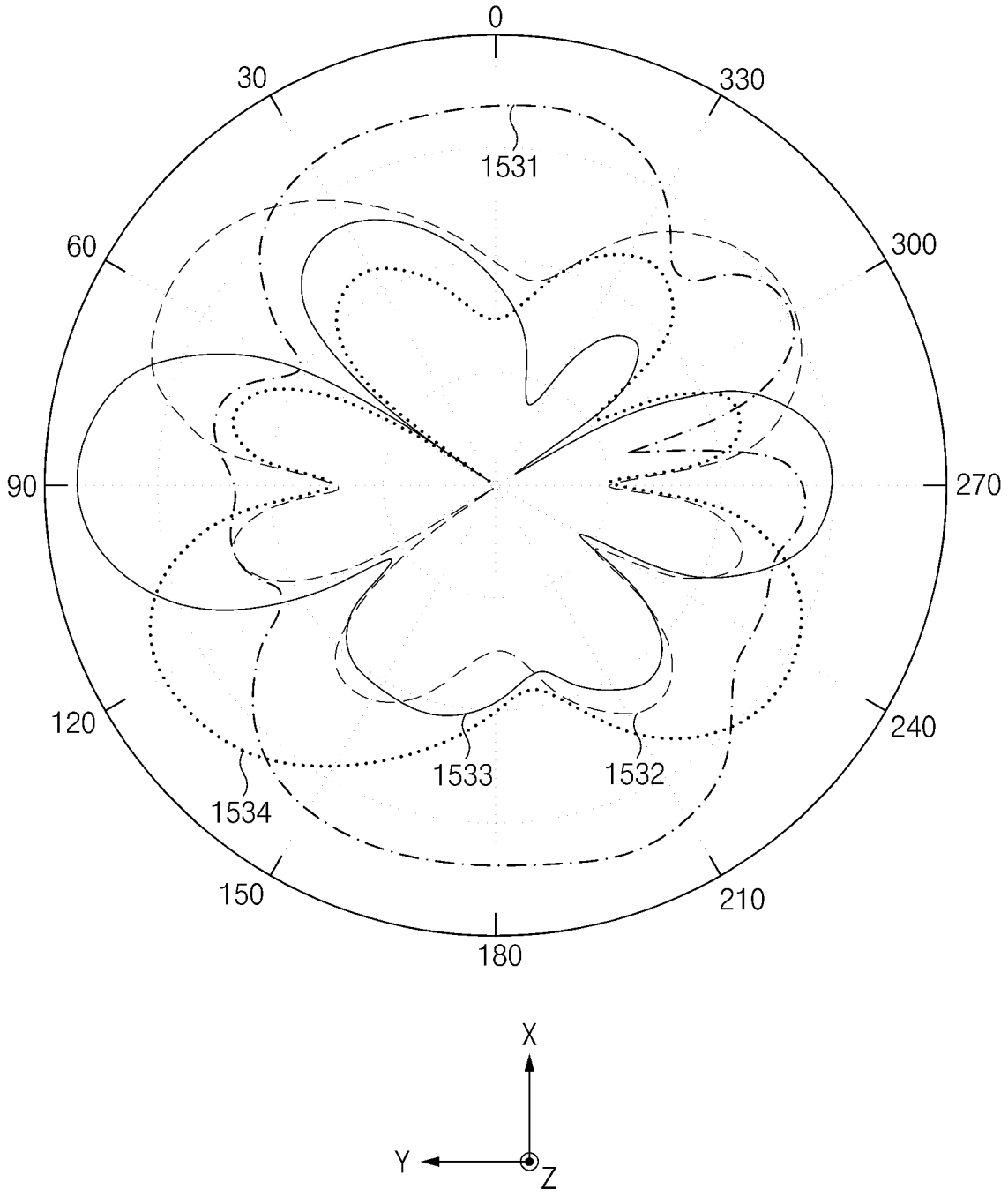
FIG. 15C is a diagram illustrating a beam pattern that an antenna module according to an embodiment forms when a first feeding terminal to an eighth feeding terminal are fed.

FIG. 15C is a diagram illustrating beam patterns 1531, 1532, 1533, and 1534 that an antenna module (e.g., the antenna module 700 of FIG. 7) according to an embodiment form when first to eighth feeding terminals (e.g., the first to eighth feeding terminals 731, 732, 733, 734, 735, 736, 737, and 738 of FIG. 7) are fed.

In an embodiment, the ninth to twelfth beam patterns 1531, 1532, 1533, and 1534 may be classified depending on phase differences. For example, the ninth beam pattern 1531 may be a beam pattern corresponding to the case where the phase difference of the first antenna 710 and the second antenna 720 is 180 degrees. In another example, the tenth beam pattern 1532 may be a beam pattern corresponding to the case where the phase difference of the first antenna 710 and the second antenna 720 is 270 degrees. In yet another example, the eleventh beam pattern 1533 may be a beam pattern corresponding to the case where the phase difference of the first antenna 710 and the second antenna 720 is 0 degree. In still yet another example, the twelfth beam pattern 1534 may be a beam pattern corresponding to the case where the phase difference of the first antenna 710 and the second antenna 720 is 90 degrees. In the case where the first to eighth feeding terminals 731, 732, 733, 734, 735, 736, 737, and 738 are fed, the ninth to twelfth beam patterns 1531, 1532, 1533, and 1534 may be steered in the shape of being radiated uniformly in all directions.

Figure 16:
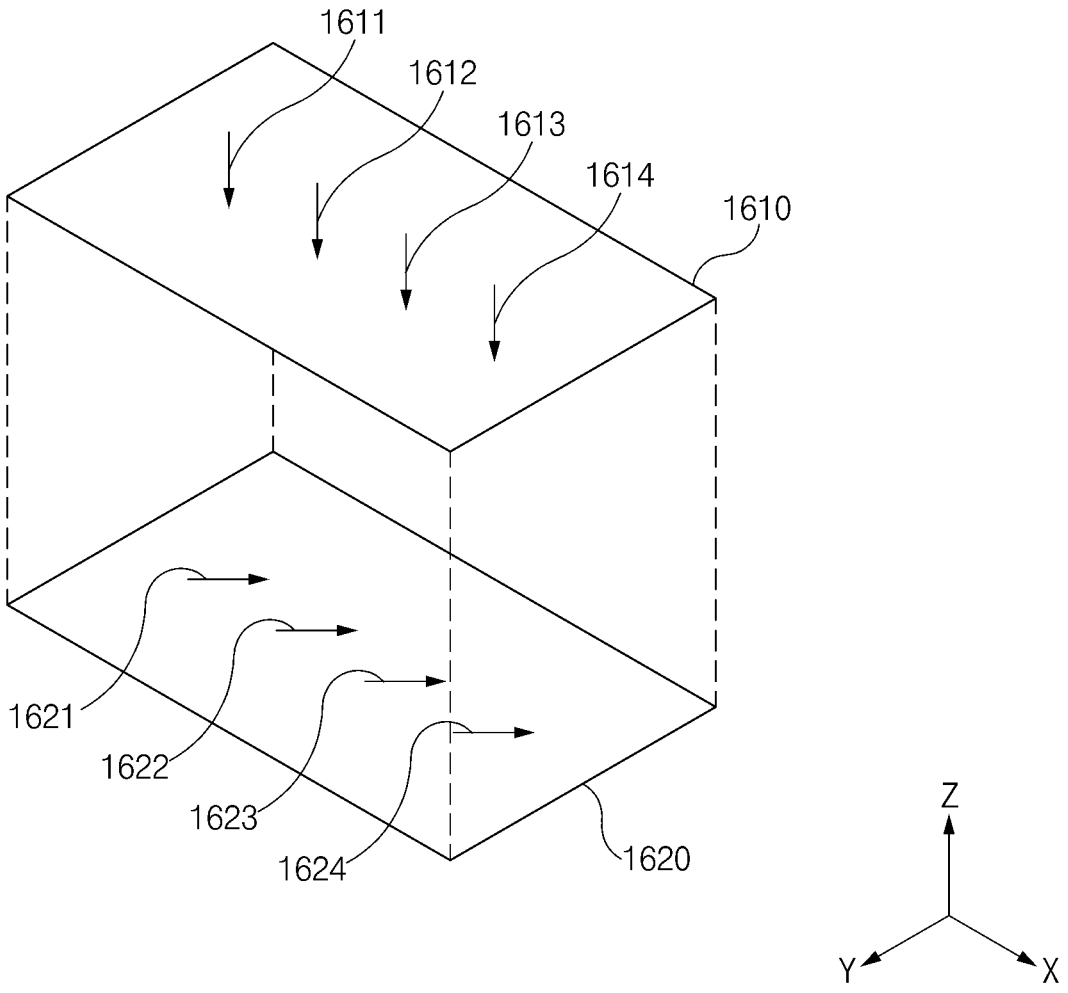
FIG. 16 is a diagram illustrating how currents flow on a first antenna and a second antenna of an antenna module according to an embodiment.

FIG. 16 is a diagram illustrating how currents flow at a first antenna 1610 and a second antenna 1620 of an antenna module (e.g., the antenna module 700 of FIG. 7) according to an embodiment.

In an embodiment, the first antenna 1610 may form a first beam pattern facing the first direction. The first antenna 1610 may form first current flows 1611, 1612, 1613, and 1614 for the purpose of forming the first beam pattern. The first current flows 1611, 1612, 1613, and 1614 may be formed at patches included in the first antenna 1610, respectively.

In an embodiment, the second antenna 1620 may form a second beam pattern facing a direction between the first direction, the second direction, and/or the third direction. Second current flows 1621, 1622, 1623, and 1624 may be formed at patches included in the second antenna 1620, respectively.

Figure 17:
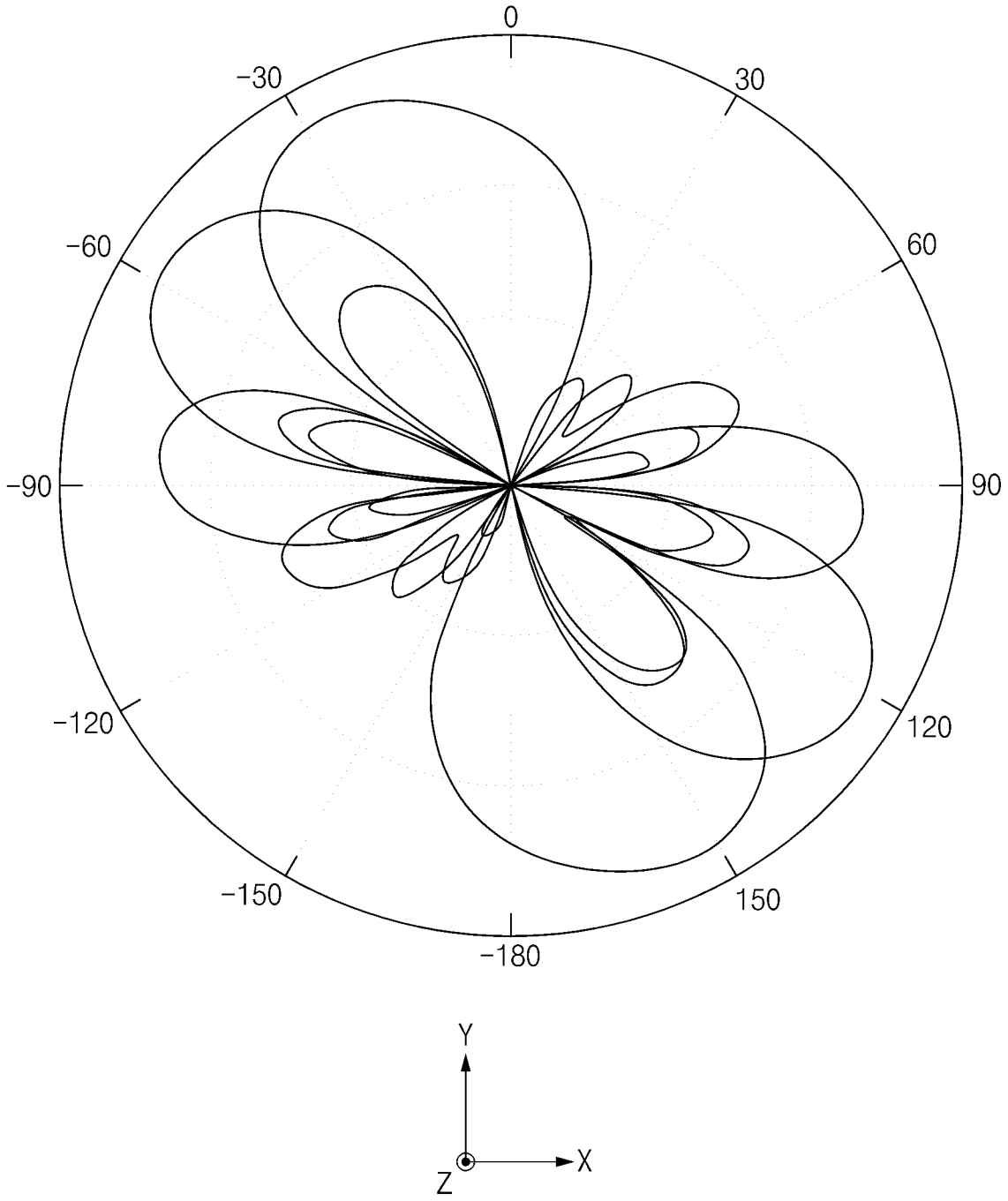
FIG. 17 is a diagram illustrating a beam pattern that a first antenna of an antenna module according to an embodiment forms.
Figure 18:
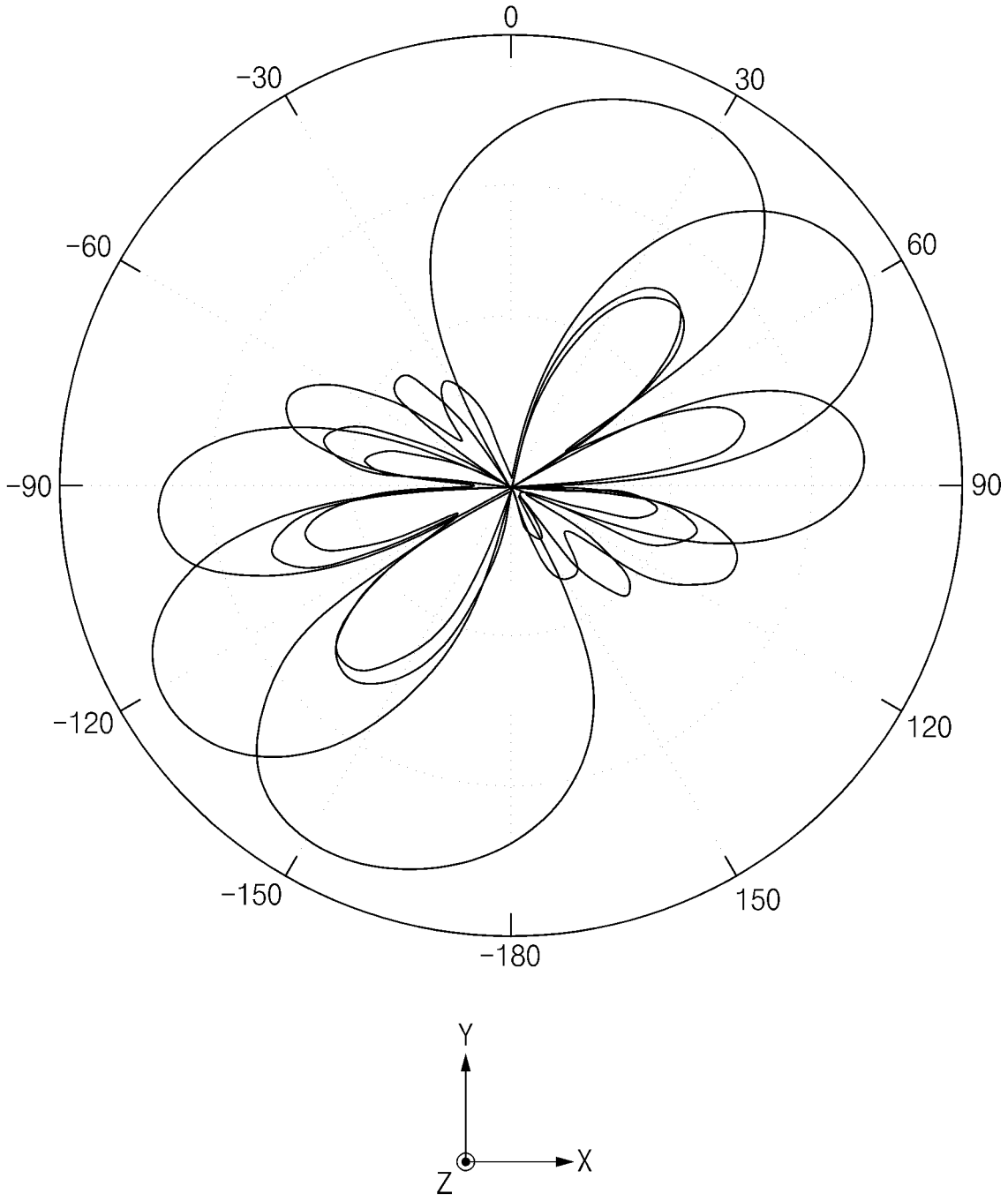
FIG. 18 is a diagram illustrating a beam pattern that a second antenna of an antenna module according to an embodiment forms.
Figure 19:
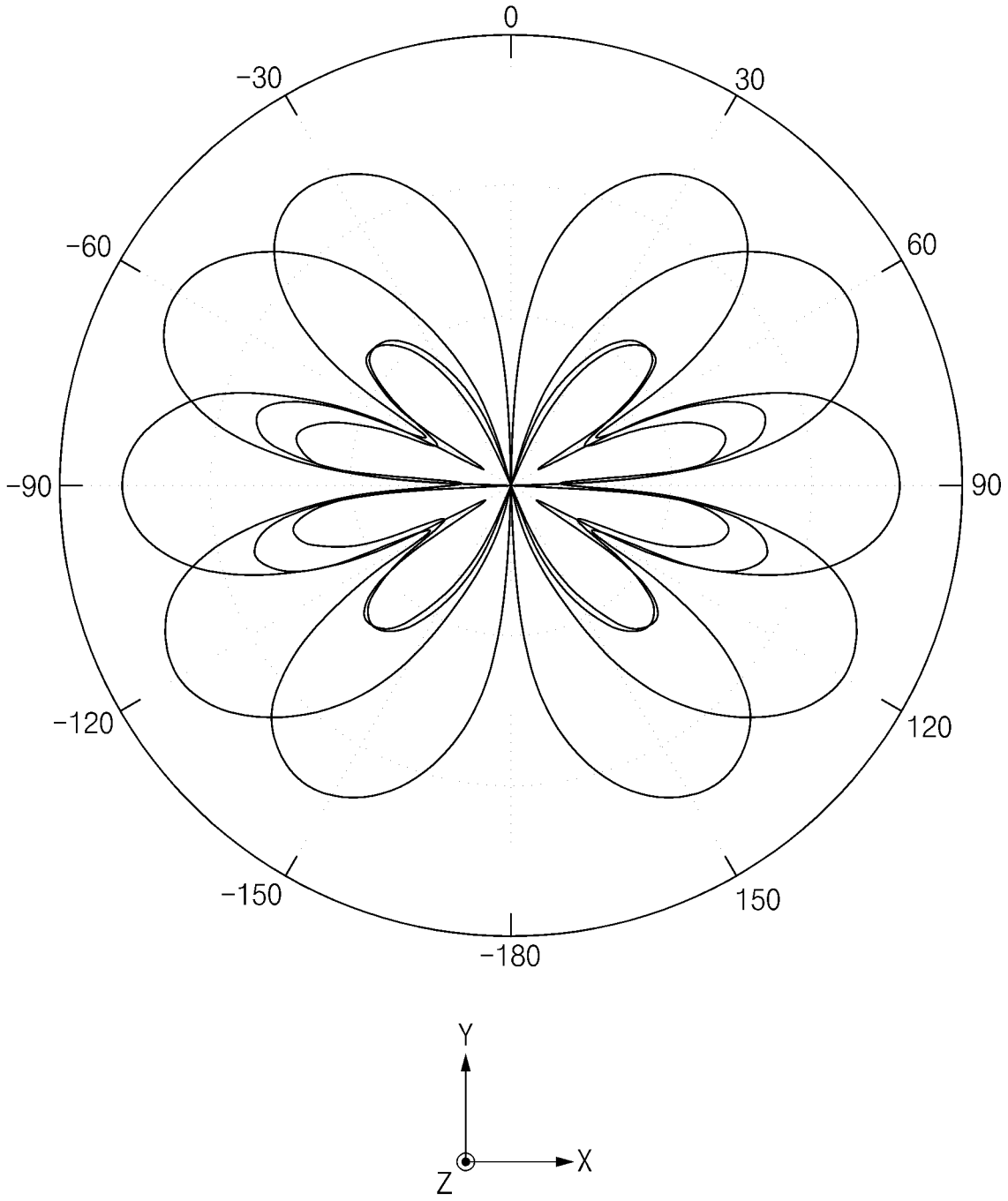
FIG. 19 is a diagram illustrating a beam pattern that a first antenna and a second antenna of an antenna module according to an embodiment form.
Figure 20:
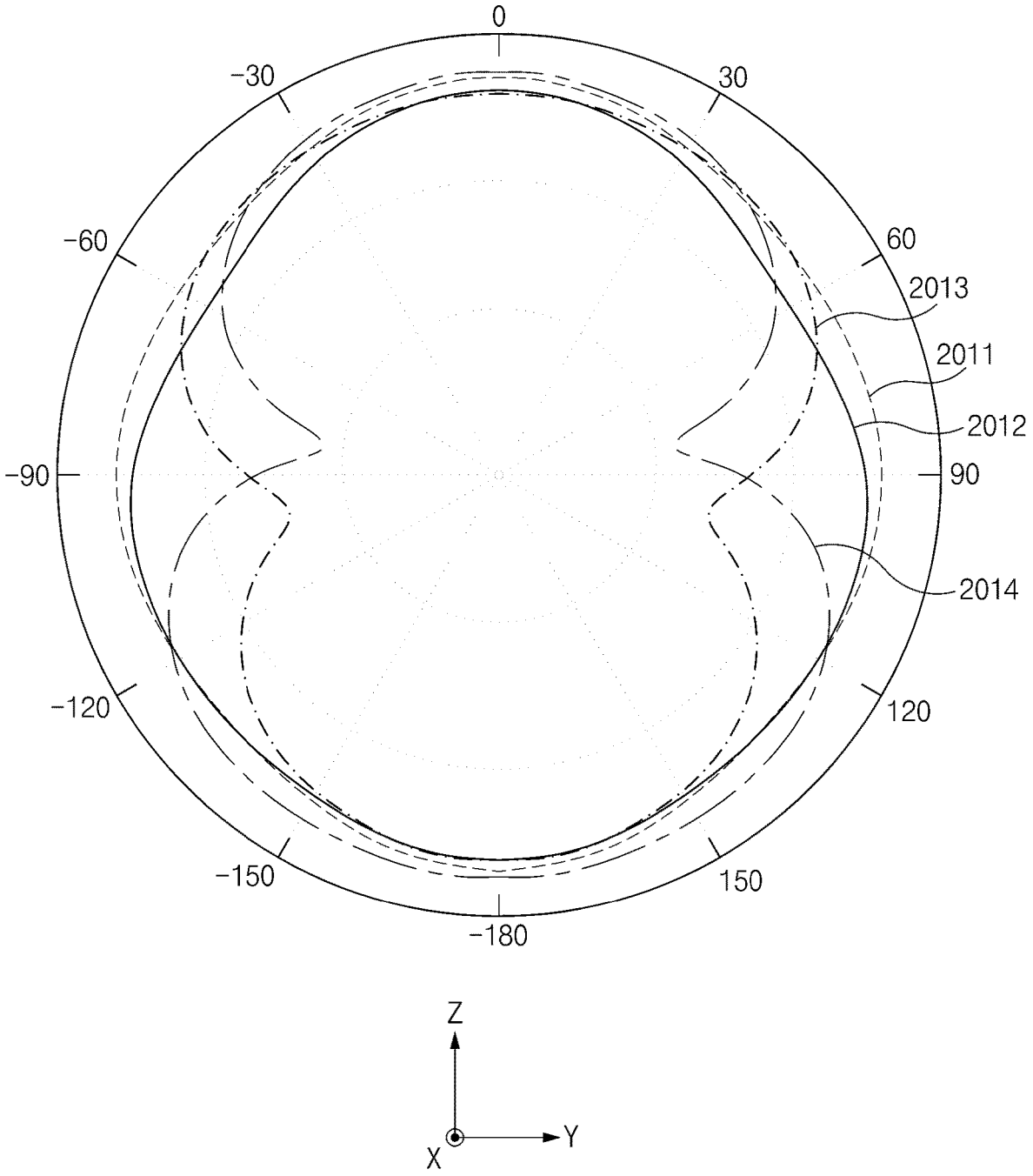
FIG. 20 is a diagram illustrating a beam pattern that a first antenna and a second antenna of an antenna module according to an embodiment form.
Figure 21:
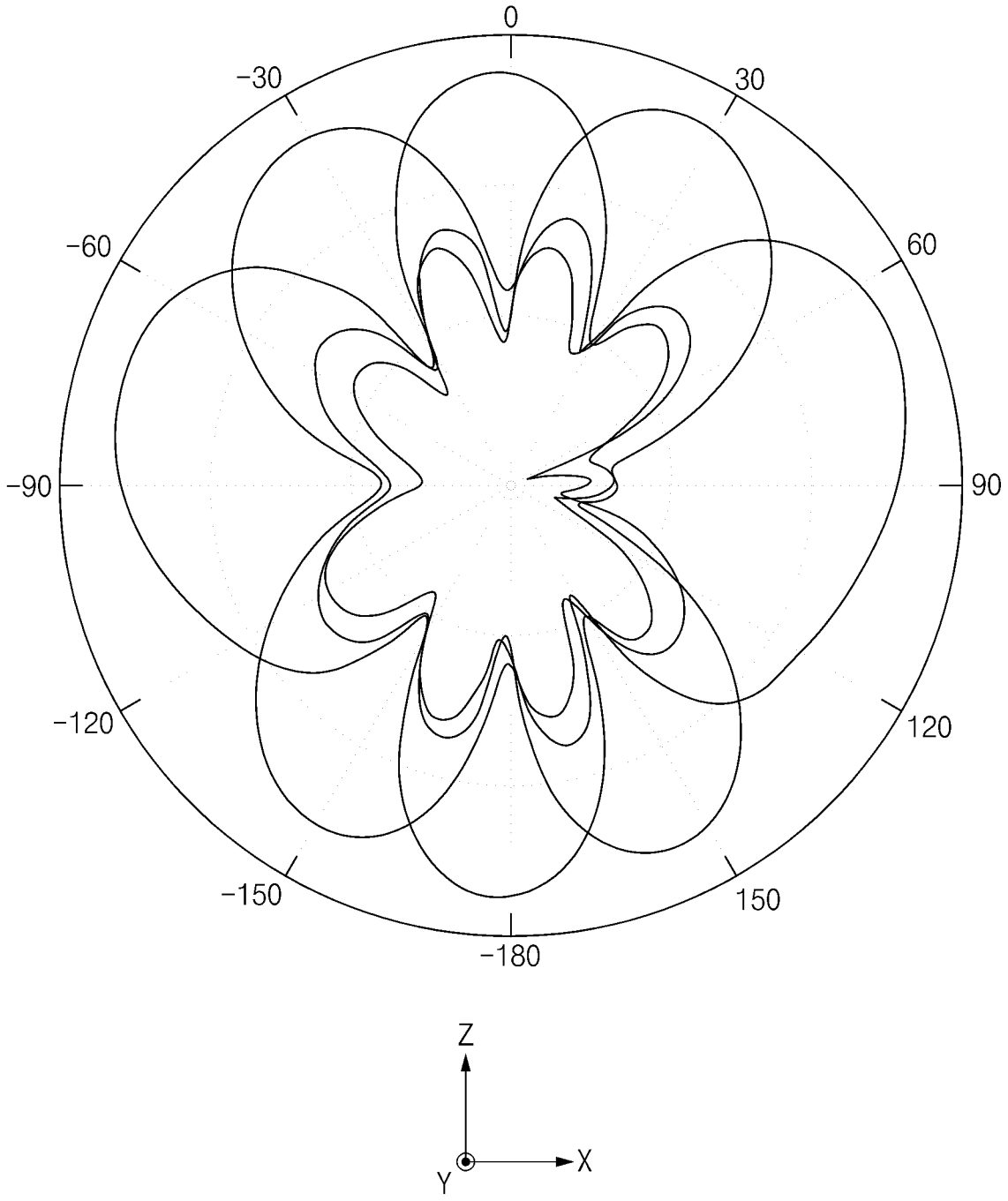
FIG. 21 is a diagram illustrating a beam pattern that a first antenna and a second antenna of an antenna module according to an embodiment form.

FIG. 17 is a diagram illustrating a beam pattern that the first antenna 1610 of an antenna module (e.g., the antenna module 700 of FIG. 7) according to an embodiment forms. FIG. 18 is a diagram illustrating a beam pattern that the second antenna 1620 of the antenna module 700 according to an embodiment forms. FIG. 19 is a diagram illustrating a beam pattern that the first antenna 1610 and the second antenna 1620 of the antenna module 700 according to an embodiment form. FIG. 20 is a diagram illustrating a beam pattern that the first antenna 1610 and the second antenna 1620 of the antenna module 700 according to an embodiment form. FIG. 21 is a diagram illustrating a beam pattern that the first antenna 1610 and the second antenna 1620 of the antenna module 700 according to an embodiment form.

In an embodiment, a direction of the second beam pattern may be determined depending on the polarization direction and/or the phase of a signal fed to each of the first antenna 1610 and the second antenna 1620. For example, a beam pattern may be strongly formed in directions of −45 degrees and +135 degrees by the first current flows 1611, 1612, 1613, and 1614 fed to the first antenna 1610 as illustrated in FIG. 17. In another example, a beam pattern may be strongly formed in directions of +45 degrees and −135 degrees by the second current flows 1621, 1622, 1623, and 1624 fed to the second antenna 1620 as illustrated in FIG. 18. In yet another example, as illustrated in FIGS. 19 to 21, a beam pattern that is formed as the first current flows 1611, 1612, 1613, and 1614 and the second current flows 1621, 1622, 1623, and 1624 are combined may be formed symmetrically with respect to 0 degree and/or 180 degrees on the XY plane, may be formed symmetrically with respect to 0 degree and/or 180 degrees on a YZ plane, and may have the directivity in a direction that a user wants on an XZ plane.

The electronic device according to various embodiments may be one of various types of electronic devices. The electronic devices may include, for example, a portable communication device (e.g., a smartphone), a computer device, a portable multimedia device, a portable medical device, a camera, a wearable device, or a home appliance. According to an embodiment of the disclosure, the electronic devices are not limited to those described above.

It should be appreciated that various embodiments of the present disclosure and the terms used therein are not intended to limit the technological features set forth herein to particular embodiments and include various changes, equivalents, or replacements for a corresponding embodiment. With regard to the description of the drawings, similar reference numerals may be used to refer to similar or related elements. It is to be understood that a singular form of a noun corresponding to an item may include one or more of the things, unless the relevant context clearly indicates otherwise. As used herein, each of such phrases as "A or B," "at least one of A and B," "at least one of A or B," "A, B, or C," "at least one of A, B, and C," and "at least one of A, B, or C," may include any one of, or all possible combinations of the items enumerated together in a corresponding one of the phrases. As used herein, such terms as "1st" and "2nd," or "first" and "second" may be used to simply distinguish a corresponding component from another, and does not limit the components in other aspect (e.g., importance or order). It is to be understood that if an element (e.g., a first element) is referred to, with or without the term "operatively" or "communicatively", as "coupled with," "coupled to," "connected with," or "connected to" another element (e.g., a second element), it means that the element may be coupled with the other element directly (e.g., wiredly), wirelessly, or via a third element.

As used herein, the term "module" may include a unit implemented in hardware, software, or firmware, and may interchangeably be used with other terms, for example, "logic," "logic block," "part," or "circuitry". A module may be a single integral component, or a minimum unit or part thereof, adapted to perform one or more functions. For example, according to an embodiment, the module may be implemented in a form of an application-specific integrated circuit (ASIC).

Various embodiments as set forth herein may be implemented as software (e.g., the program 140) including one or more instructions that are stored in a storage medium (e.g., internal memory 136 or external memory 138) that is readable by a machine (e.g., the electronic device 101). For example, a processor (e.g., the processor 120) of the machine (e.g., the electronic device 101) may invoke at least one of the one or more instructions stored in the storage medium, and execute it, with or without using one or more other components under the control of the processor. This allows the machine to be operated to perform at least one function according to the at least one instruction invoked. The one or more instructions may include a code generated by a compiler or a code executable by an interpreter. The machine-readable storage medium may be provided in the form of a non-transitory storage medium. Wherein, the term "non-transitory" simply means that the storage medium is a tangible device, and does not include a signal (e.g., an electromagnetic wave), but this term does not differentiate between where data is semi-permanently stored in the storage medium and where the data is temporarily stored in the storage medium.

According to an embodiment, a method according to various embodiments of the disclosure may be included and provided in a computer program product. The computer program product may be traded as a product between a seller and a buyer. The computer program product may be distributed in the form of a machine-readable storage medium (e.g., compact disc read only memory (CD-ROM)), or be distributed (e.g., downloaded or uploaded) online via an application store (e.g., PlayStore™), or between two user devices (e.g., smart phones) directly. If distributed online, at least part of the computer program product may be temporarily generated or at least temporarily stored in the machine-readable storage medium, such as memory of the manufacturer's server, a server of the application store, or a relay server.

According to various embodiments, each component (e.g., a module or a program) of the above-described components may include a single entity or multiple entities. According to various embodiments, one or more of the above-described components may be omitted, or one or more other components may be added. Alternatively or additionally, a plurality of components (e.g., modules or programs) may be integrated into a single component. In such a case, according to various embodiments, the integrated component may still perform one or more functions of each of the plurality of components in the same or similar manner as they are performed by a corresponding one of the plurality of components before the integration. According to various embodiments, operations performed by the module, the program, or another component may be carried out sequentially, in parallel, repeatedly, or heuristically, or one or more of the operations may be executed in a different order or omitted, or one or more other operations may be added.

According to embodiments of the disclosure, beam patterns may be formed in a plurality of directions by implementing an array antenna of a patch structure on two (or opposite) surfaces of an antenna module with one PCB.

Also, according to embodiments of the disclosure, the direction of the beam pattern may be variously steered in a range of 360 degrees at an electronic device in which an antenna module is mounted.

In addition, a variety of effects directly or indirectly understood through this disclosure may be provided.

Certain of the above-described embodiments of the present disclosure can be implemented in hardware, firmware or via the execution of software or computer code that can be stored in a recording medium such as a CD ROM, a Digital Versatile Disc (DVD), a magnetic tape, a RAM, a floppy disk, a hard disk, or a magneto-optical disk or computer code downloaded over a network originally stored on a remote recording medium or a non-transitory machine readable medium and to be stored on a local recording medium, so that the methods described herein can be rendered via such software that is stored on the recording medium using a general purpose computer, or a special processor or in programmable or dedicated hardware, such as an ASIC or FPGA. As would be understood in the art, the computer, the processor, microprocessor controller or the programmable hardware include memory components, e.g., RAM, ROM, Flash, etc. that may store or receive software or computer code that when accessed and executed by the computer, processor or hardware implement the processing methods described herein.

While the disclosure has been shown and described with reference to various embodiments thereof, it will be understood by those skilled in the art that various changes in form and details may be made therein without departing from the spirit and scope of the disclosure as defined by the appended claims and their equivalents.

What is claimed is:

1. An antenna module comprising:

a printed circuit board (PCB) including a first surface facing a first direction, a second surface facing a second direction opposite to the first surface, and a third surface facing a third direction perpendicular to the first direction and the second direction;

a first antenna disposed on the first surface;

a second antenna including a first portion disposed on the second surface, a second portion extended from a first point of the first portion in the first direction so as to be adjacent to the third surface, and a third portion extended from a second point of the second portion so as to face the first antenna;

at least one ground layer interposed between the first antenna and the second antenna and extending in the third direction, the at least one ground layer including a bending portion bent to face the first direction from the third direction; and at least one wire configured to feed the first antenna and the second antenna, wherein the first antenna and at least a portion of the first portion excluding the first point overlap each other when viewed in the second direction, wherein the first antenna and the second portion are disposed to be spaced from each other in the third direction, and wherein at least a portion of the at least one ground layer is interposed between the first antenna and the second portion.

2. The antenna module of claim 1, wherein the at least one wire includes:

a first wire connected with a first conductive pattern disposed adjacent to the first antenna; and a second wire connected with a second conductive pattern disposed adjacent to the second antenna, wherein the first conductive pattern is coupled with the first antenna, and wherein the second conductive pattern is coupled with the second antenna.

3. The antenna module of claim 1, wherein the first antenna includes:

a first feeding terminal configured to perform first feeding on the first antenna so as to form a first current parallel to the first surface; and a second feeding terminal configured to perform second feeding on the first antenna so as to form a second current parallel to the first surface and perpendicular to the first current, and wherein the second antenna includes:

a third feeding terminal configured to perform third feeding on the second antenna so as to form a third current parallel to the first current; and a fourth feeding terminal configured to perform fourth feeding on the second antenna so as to form a fourth current parallel to the second current.

4. The antenna module of claim 1, wherein a phase difference of a first signal fed to the first antenna and a second signal fed to the second antenna is 180 degrees.

5. The antenna module of claim 1, wherein the first antenna forms a first beam pattern facing the first direction, wherein the second antenna forms a second beam pattern facing a direction between the first direction, the second direction, and/or the third direction, and wherein the direction of the second beam pattern is determined based on a location of the first point of the second antenna, a location of the second point of the second antenna, a size of the first portion, a size of the second portion, and/or a size of the third portion of the second antenna.

6. The antenna module of claim 1, wherein the first antenna forms a first beam pattern facing the first direction, wherein the second antenna forms a second beam pattern facing a direction between the first direction, the second direction, and/or the third direction, and wherein the direction of the second beam pattern is determined based on a polarization direction and/or a phase of a signal fed to the second antenna.

7. The antenna module of claim 1, wherein the second portion of the second antenna is formed with a conductive via.

8. The antenna module of claim 1, wherein a hole is formed within the second antenna, wherein a third antenna is implemented on the third surface by using the hole, and wherein the third antenna forms a third beam pattern facing a direction between the first direction, the second direction, and/or the third direction.

9. An antenna module comprising:

a printed circuit board (PCB) including a first surface facing a first direction, a second surface facing a second direction opposite to the first direction, and a third surface facing a third direction perpendicular to the first direction and the second direction;

a first antenna disposed on the first surface;

a second antenna disposed on the second surface, wherein at least a portion of the second antenna is disposed to overlap the first antenna when viewed in the second direction;

at least one ground layer interposed between the first antenna and the second antenna;

a first feeding terminal configured to feed a first signal having a first phase to the first antenna;

a second feeding terminal configured to feed a second signal having a second phase to the first antenna;

a third feeding terminal disposed to face the first feeding terminal, and configured to feed a third signal having a third phase to the second antenna; and a fourth feeding terminal disposed to face the first feeding terminal, and configured to feed a fourth signal having a fourth phase to the second antenna, wherein a first current flow is formed on the first antenna by the first signal and the second signal, wherein a second current flow different from the first current flow is formed on the second antenna by the third signal and the fourth signal, wherein the first feeding terminal is fed in synchronization with the third feeding terminal, and wherein the second feeding terminal is fed in synchronization with the fourth feeding terminal.

10. The antenna module of claim 9, wherein the first current flow is formed on the first antenna to be parallel to the first surface, and wherein the second current flow is formed on the second antenna to be parallel to the second surface.

11. The antenna module of claim 9, wherein a phase difference of the first current flow and the second current flow is 180 degrees.

12. The antenna module of claim 9, wherein the PCB includes:

a first PCB including the first surface; and a second PCB including the second surface, wherein a first antenna array including the first antenna is formed on the first PCB, and wherein a second antenna array including the second antenna is formed on the second PCB.

13. The antenna module of claim 9, further comprising:

a first wire connected with a first conductive pattern disposed adjacent to the first antenna; and a second wire connected with a second conductive pattern disposed adjacent to the second antenna, wherein the first conductive pattern is coupled with the first antenna, and wherein the second conductive pattern is coupled with the second antenna.

14. The antenna module of claim 13, wherein the first antenna forms a first beam pattern facing the first direction, wherein the second antenna forms a second beam pattern facing a direction between the first direction, the second direction, and/or the third direction, and wherein directions of the first beam pattern and the second beam pattern are determined depending on a first electrical length of the first wire and/or a second electrical length of the second wire.

15. The antenna module of claim 9, wherein the first antenna forms a first beam pattern facing the first direction, wherein the second antenna forms a second beam pattern facing a direction between the first direction, the second direction, and/or the third direction, and wherein directions of the first beam pattern and the second beam pattern are determined based on a first delay time of the first signal of the first antenna and/or a second delay time of the second signal of the second antenna.

16. An electronic device comprising:

a housing including a front plate, a back plate facing away from the front plate, and a side member formed in a space between the front plate and the back plate, wherein at least a part of the side member is made of a conductive material; and an antenna module disposed within the housing, wherein the antenna module includes:

a printed circuit board (PCB) including a first surface, a second surface parallel to the first surface, and a third surface connecting the first surface and the second surface;

a first antenna disposed on the first surface;

a second antenna extended from the second surface while being bent to face the third surface and extended from the third surface while being bent to face the first antenna on the first surface;

at least one ground layer interposed between the first antenna and the second antenna, and including a bending portion bent in a shape corresponding to the second antenna;

a radio frequency integrated circuit (RFIC) disposed adjacent to the second surface; and at least one wire configured to connect the first antenna and the second antenna with the RFIC, wherein the second antenna is disposed to be spaced apart from the RFIC.

17. The electronic device of claim 16, wherein a portion of the second antenna is formed on an outside of the third surface of the PCB and is exposed in at least a portion of the side member of the housing.

18. The electronic device of claim 16, wherein a portion of the second antenna is formed with a conductive via provided within the PCB to be adjacent to the third surface.

19. The electronic device of claim 16, wherein a phase difference of a first signal fed to the first antenna and a second signal fed to the second antenna is 180 degrees.

20. The electronic device of claim 16, wherein the first antenna forms a first beam pattern facing a first direction, wherein the second antenna forms a second beam pattern facing a direction between the first direction, a second direction, and/or a third direction, wherein a hole is formed within a portion of the second antenna, wherein a third antenna is implemented on the third surface by using the hole, and wherein the third antenna forms a third beam pattern facing a direction between the first direction, the second direction, and/or the third direction.

* * * * *